United States Patent [19]

Wind

[11] Patent Number: 4,580,680

[45] Date of Patent: Apr. 8, 1986

[54] SHIPPING PALLET AND CONTAINER FORMED THEREFROM

[75] Inventor: Joseph H. Wind, Taylors, S.C.

[73] Assignee: Bigelow-Sanford, Inc., Greenville, S.C.

[21] Appl. No.: 576,917

[22] Filed: Feb. 3, 1984

Related U.S. Application Data

[63] Continuation-in-part of Ser. No. 434,173, Oct. 13, 1982, Pat. No. 4,480,748, which is a continuation-in-part of Ser. No. 295,524, Aug. 24, 1981, Pat. No. 4,413,737.

[51] Int. Cl.[4] ..... B65D 85/676; B65D 19/00; B65D 19/38; B65D 21/02

[52] U.S. Cl. ..... 206/386; 108/55.3; 206/392; 206/511; 206/599; 206/600; 217/43 A

[58] Field of Search ..... 206/392, 599, 600, 595, 206/508, 509, 511; 108/55.3; 217/43 A

[56] References Cited

U.S. PATENT DOCUMENTS

| | | | |
|---|---|---|---|
| 2,704,600 | 3/1955 | Despres | 206/392 |
| 2,893,588 | 7/1959 | Martin | 206/599 |
| 3,145,870 | 8/1964 | Lockwood | 220/4 E |
| 3,375,919 | 4/1968 | Schlager | 220/392 |
| 3,948,190 | 4/1976 | Cook | 206/599 |
| 4,000,704 | 1/1977 | Griffin | 206/599 |
| 4,202,448 | 5/1980 | Jaeger | 206/392 |
| 4,254,873 | 3/1981 | Cook | 206/599 |

FOREIGN PATENT DOCUMENTS

| | | | |
|---|---|---|---|
| 1297833 | 11/1972 | United Kingdom | 206/392 |

*Primary Examiner*—George E. Lowrance

*Attorney, Agent, or Firm*—Bell, Seltzer, Park & Gibson

[57] ABSTRACT

A shipping pallet is provided formed of a unitary sheet of material and having a generally planar base with a plurality of spaced proturberances extending upwardly from the upper surface of the base. The protuberances are adapted to receive respective items to be shipped thereon and to maintain such items in a predetermined relationship. The pallets further include a plurality of foot means projecting downwardly from the base, with portions of said foot means being proximal to each upwardly projecting protuberance so that said foot means effect enhanced support for items to be positioned on the protuberances and effect enhanced load distribution for the items positioned on the pallet. Additionally, a shipping container formed from two of the shipping pallets is provided for containing and transporting a load of items or packages having tubular carrier cores. In the container, the respective protuberances on the upper and lower pallets are substantially in alignment with each other and are received within the tubular carrier cores of the load of items. The protuberances substantially prevent the engaged items from shifting laterally in any direction relative to each other and thereby maintain the items in a predetermined relationship within the container. Where the load of items comprises a plurality of layers, stabilizing means are further provided for cooperating with the items of adjacent layers, thereby preventing lateral shifting of the items relative to each other and thus maintaining the items of the load in a predetermined relationship within the container.

21 Claims, 29 Drawing Figures

SHIPPING PALLET AND CONTAINER FORMED THEREFROM

This application is a continuation-in-part of my copending United States application Ser. No. 434,173, filed Oct. 13, 1982, now U.S. Pat. No. 4,480,748, and entitled SHIPPING PALLET AND CONTAINER AND ASSOCIATED METHOD, which is in turn, a continuation-in-part of my United States application Ser. No. 295,524, filed Aug. 24, 1981, entitled SHIPPING PALLET AND A PACKAGE FORMED THEREFROM, now U.S. Pat. No. 4,413,737.

This invention relates to an improved shipping pallet of integrally molded construction, and to an improved industrial shipping container formed from a pair of such pallets with a load-enclosing sleeve extending therebetween.

As disclosed in my said copending application and in my said patent, my prior pallet is so configured that, when a plurality of such pallets are assembled into shipping containers of the type described above, a bottom pallet of one container will mate with an inverted top pallet of a lower container, when a plurality of such containers are stacked, in such a way as to prevent lateral shifting of adjacent containers relative to each other. My prior pallet is also self-nesting for transport or storage when unloaded, and containers formed from such pallets will stack in mating relationship even though adjacent mutually inverse pallets are reoriented or rotated 180° in a horizontal plane relative to each other.

The present invention is an improvement in my prior pallets in that, in addition to including the features of mating of adjacent shipping containers when stacked, nesting of pallets when unloaded, and mating of stacked containers even after a respective 180° rotation thereof, the present invention also includes a plurality of spaced protuberances extending upwardly from the upper surface of the planar base of the pallet for receiving thereon individual items, such as packages of yarn and reels of wire or other strand material, and for maintaining the items in a predetermined relationship.

It is therefore an object of this invention to provide a shipping pallet of the type described formed of a single unitary sheet of material configured to include a plurality of spaced protuberances extending upwardly from the base of the pallet for receiving thereon respective items to be shipped and for maintaining such items in a predetermined relationship.

More specifically, my prior shipping pallet includes a generally planar base having a plurality of foot means projecting downwardly therefrom, and each foot means includes at least one projecting member and an adjacent platform member, with the foot means being so arranged relative to each other that the pallet when in use in a predetermined position of orientation, and at least another position of orientation 180° out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions.

According to the present invention, the improved pallet is further provided with a plurality of rectilinear rows of spaced protuberances extending upwardly from the upper surface of the base for receiving thereon respective items to be shipped and for maintaining the items in predetermined relationship. The rows of protuberances are arranged in lengthwise and widthwise extending rows with all the protuberances being of substantially the same size and shape and being uniformly spaced apart from each other. Also, the upwardly extending protuberances are so positioned that at least portions of the downwardly projecting members of the foot means are located proximal to each upwardly extending protuberance and are within imaginary circles all of a similar size.

Each circle has a diameter no greater than the distance between adjacent protuberances and is circumscribed about substantially the center of each respective upwardly extending protuberance so that the aforementioned portions of the downwardly projecting members of the foot means effect enhanced support for items to be positioned on the protuberances and effect enhanced load distribution for the items positioned on the pallet. Additionally, the upwardly extending protuberances are so positioned that the pallet when in use in the aforementioned predetermined position of orientation, and at least another position of orientation 180° out-of-phase therefrom, may be stacked in mating relation to a substantially identical inverted pallet in the manner set forth above.

The prior type of shipping pallet discussed above, as well as the pallet of this invention, is provided with an outer peripheral rim which extends upwardly relative to the pallet base. A sleeve-receiving groove extends alongside of and is surrounded by the rim for accommodating the corresponding end portion of a sleeve used in assembling a shipping container. Those protuberances located closest to the sleeve-receiving groove are spaced from the groove a distance substantially half that of the distance that the protuberances are spaced apart from each other.

As an example of the application of the improved pallet, in the textile industry yarn is often packaged by winding it around tubular carrier cores, commonly called yarn carriers, which may take the form of a spool, bobbin or the like. Where yarn is packaged on such a yarn carrier, there generally is provided no protection for individual packages of yarn other than the larger container in which a number of yarn packages are typically carried. As a result, in the event that individual yarn packages move relative to one another within a shipping container, the yarn packages may abrade one another. The nature of yarn is such that abrasion oftentimes causes damage to the yarn, making the yarn in the outer portions of the package unsuitable for further textile applications, or in extreme cases relegating the entire yarn package to waste.

The plurality of spaced protuberances extending upwardly from the base of the improved pallet are adapted to receive thereon individual items, such as the tubular carrier cores of the yarn packages. Once received, the protuberances maintain the items in a predetermined spaced relationship, thereby helping to prevent relative motion of the items within a shipping container and further preventing any consequent damage to the individual items, such as abrasion damage to yarn packages. Consequently, the present invention may be used to form improved shipping containers in which individual items may be maintained in a predetermined relationship within the shipping container while the container is being transported or stored.

Some of the objects and advantages of the invention having been stated, others will appear as the description proceeds when taken in connection with the accompanying drawings, in which FIG. 1 is a perspective view looking at the top and two sides of a first embodiment of the pallet;

FIG. 19 is a perspective view similar to FIG. 1, but illustrating a second embodiment of the improved pallet particularly adapted to accommodate flanged items such as flanged reels of wire or the like;

Figure 12:
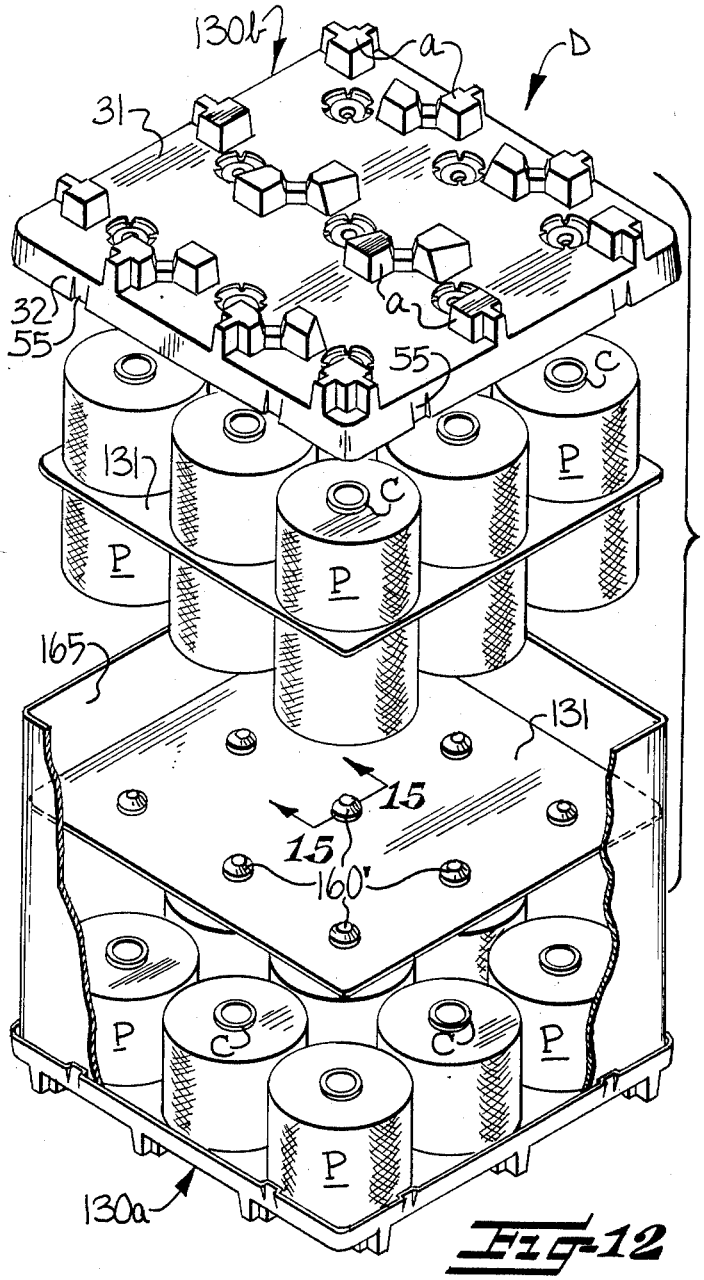
FIG. 12 is a partially exploded view, with portions broken away, showing a single shipping container formed from said pallets with multiple layers of individual items loaded therein.
Figure 13:
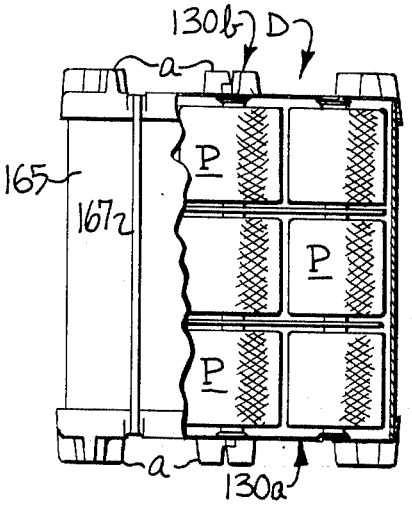
FIG. 13 is a side elevational view of the container of FIG. 12 with portions of the upper and lower pallets and an intervening sleeve broken away to show layers of individual items in the shipping container.
Figure 14:
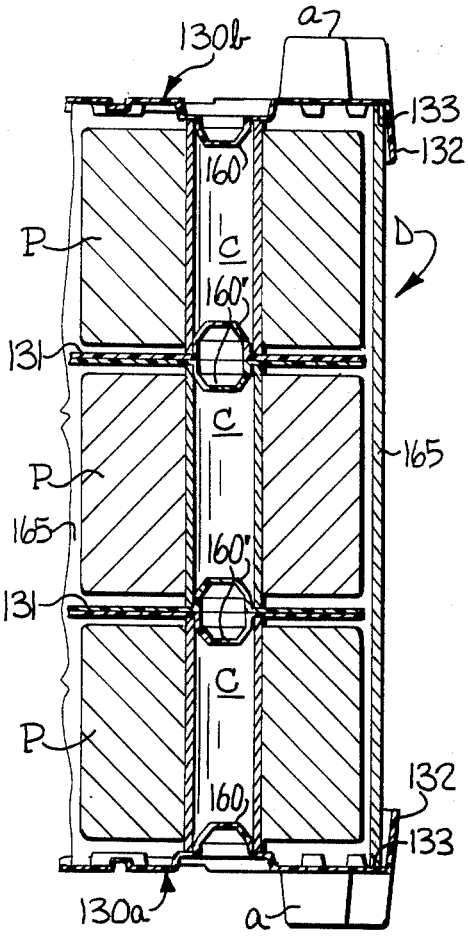
FIG. 14 is an enlarged fragmentary cross sectional view of the container of FIG. 12 showing how a column of individual items therein are maintained in a predetermined relationship.
Figure 26:
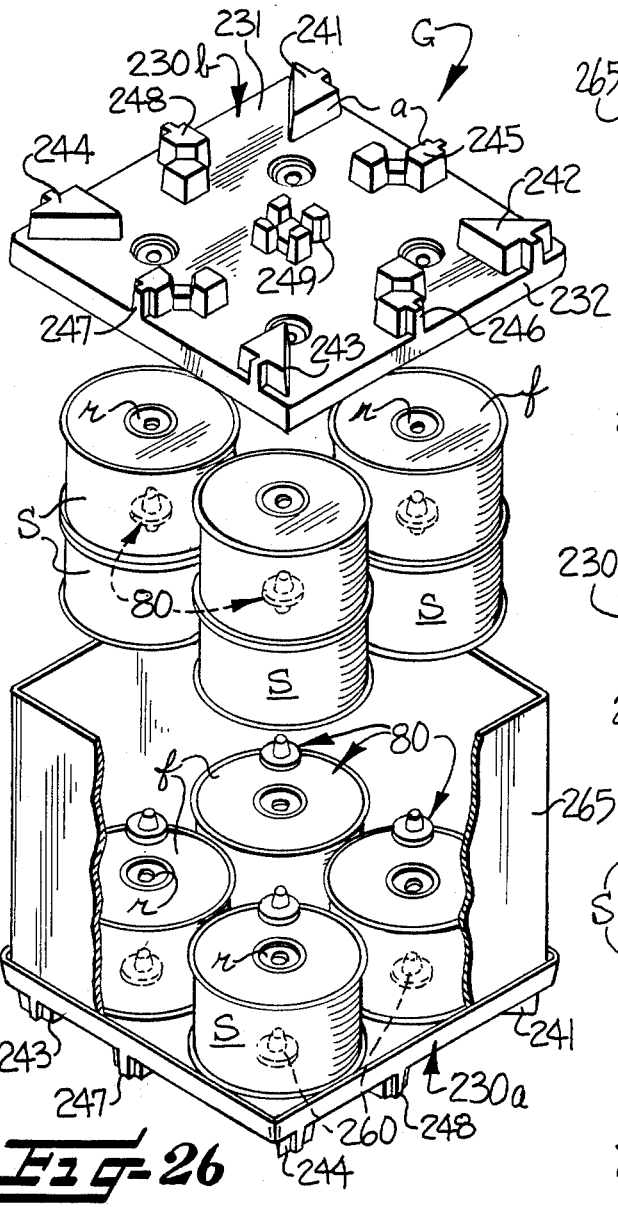
Figure 27:
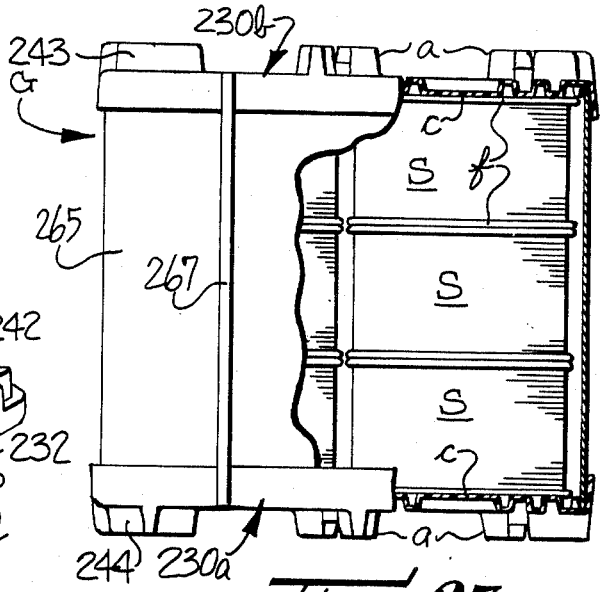
Figure 29:
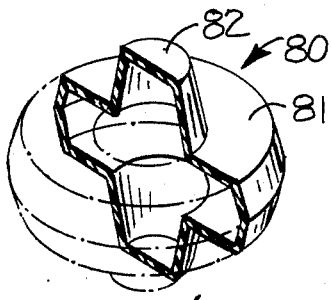
Figure 28:
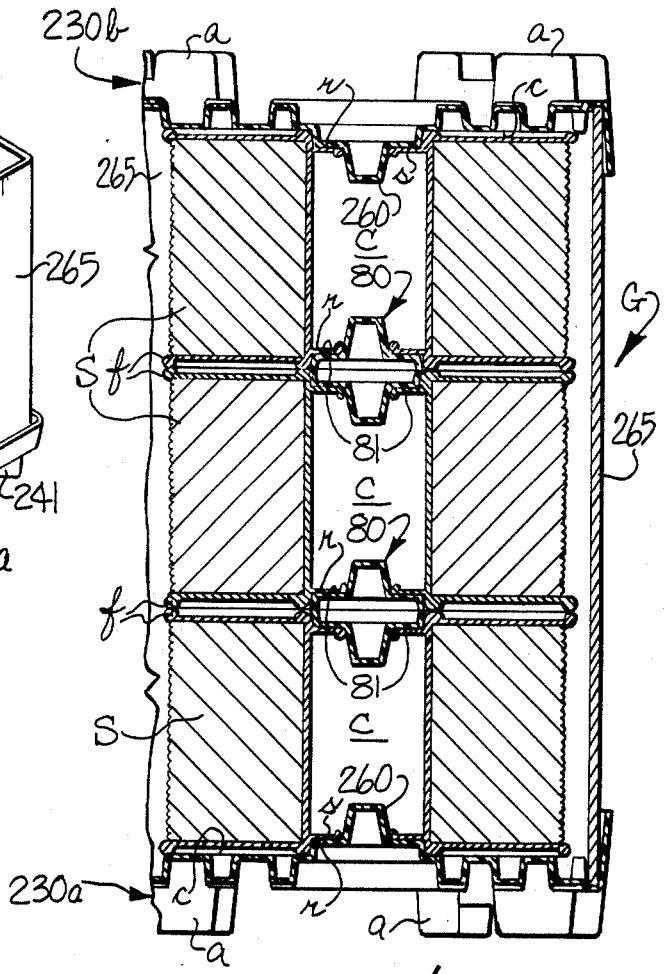

FIGS. 26, 27 and 28 are views similar to the respective FIGS. 12, 13 and 14, but illustrating the second embodiment of the pallet with multiple layers of flanged items loaded in a container formed from two of such pallets and a sleeve extending therebetween; and FIG. 29 is an enlarged perspective and partial cross sectional view of one of the several stabilizing adapters, having opposing protuberances thereon, shown in FIGS. 26 and 28.

Figure 8:
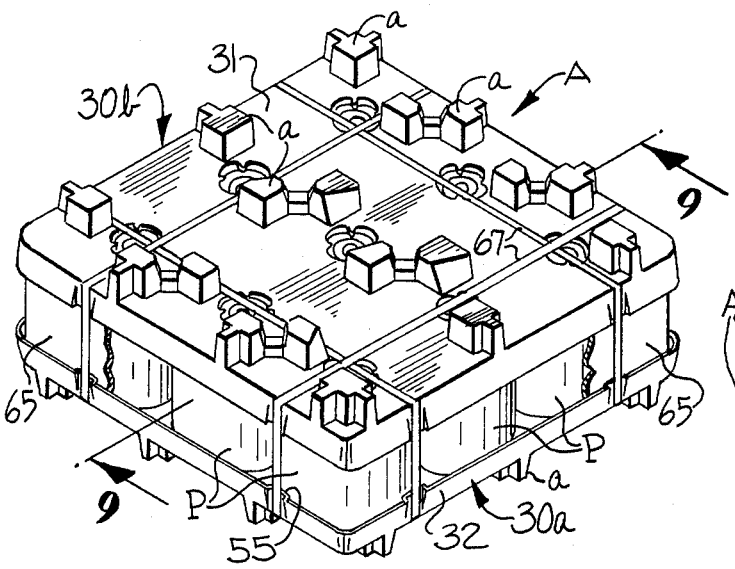
FIG. 8 is a partially cut away perspective view of a shipping container formed from two of the pallets and a single layer of individual items and omitting, for the purpose of clarity, many of the relatively small details in the pallets.
Figure 9:
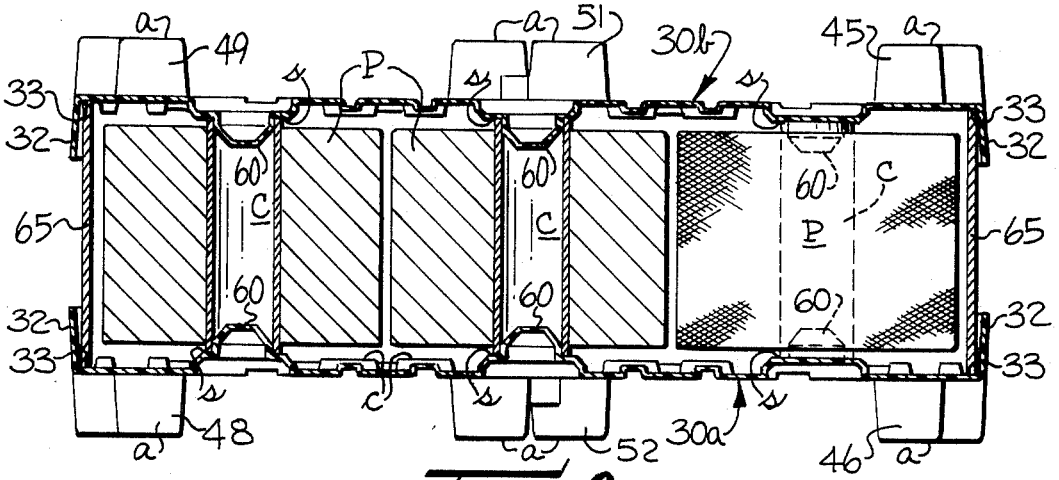
FIG. 9 is an enlarged cross sectional view through the shipping container taken substantially along line 9—9 in FIG. 8 and illustrating how the items are maintained in the desired relationship by the protuberances on the upper and lower pallets.

Referring more specifically to the drawings, the first embodiment of the improved shipping pallet is shown in FIGS. 1–7 where it is broadly designated at 30, and one form of a shipping container of this invention, formed of two of the improved pallets and a sleeve therebetween, is shown in FIGS. 8 and 9 where it is broadly designated at A. Although the pallets of container A are substantially identical to each other and to the pallet 30 of FIGS. 1–7, the two lower and upper pallets of FIGS. 8 and 9 are designated at 30*a*, 30*b*, respectively, for the purpose of clarity. The container A will be described later herein, following the detailed description of the shipping pallet 30.

As indicated earlier herein the pallet of the present invention is an improvement in pallets of the type disclosed in U.S. Pat. No. 4,413,737 and in my copending application Ser. No. 434,173. Accordingly those elements of pallet 30 which are generally similar to those elements of my prior pallet will first be described, followed by a description of the improvements of the present invention.

The pallet 30 is formed of a unitary sheet of moldable or deformable material, preferably a vacuum moldable thermoplastic material such as polyethylene or the like. As shown in FIGS. 1–7, the shipping pallet 30 comprises a substantially rectangular or square, generally planar base 31 having an outwardly extending peripheral rim 32 thereon which projects upwardly when the pallet 30 is serving as the bottom of a container, and which projects downwardly when serving as the top of a container. A peripheral sleeve-receiving groove 33 (FIGS. 4–6 and 9) is provided between the rim 32 and the portions of the base surrounded by the rim 32.

Figure 2:
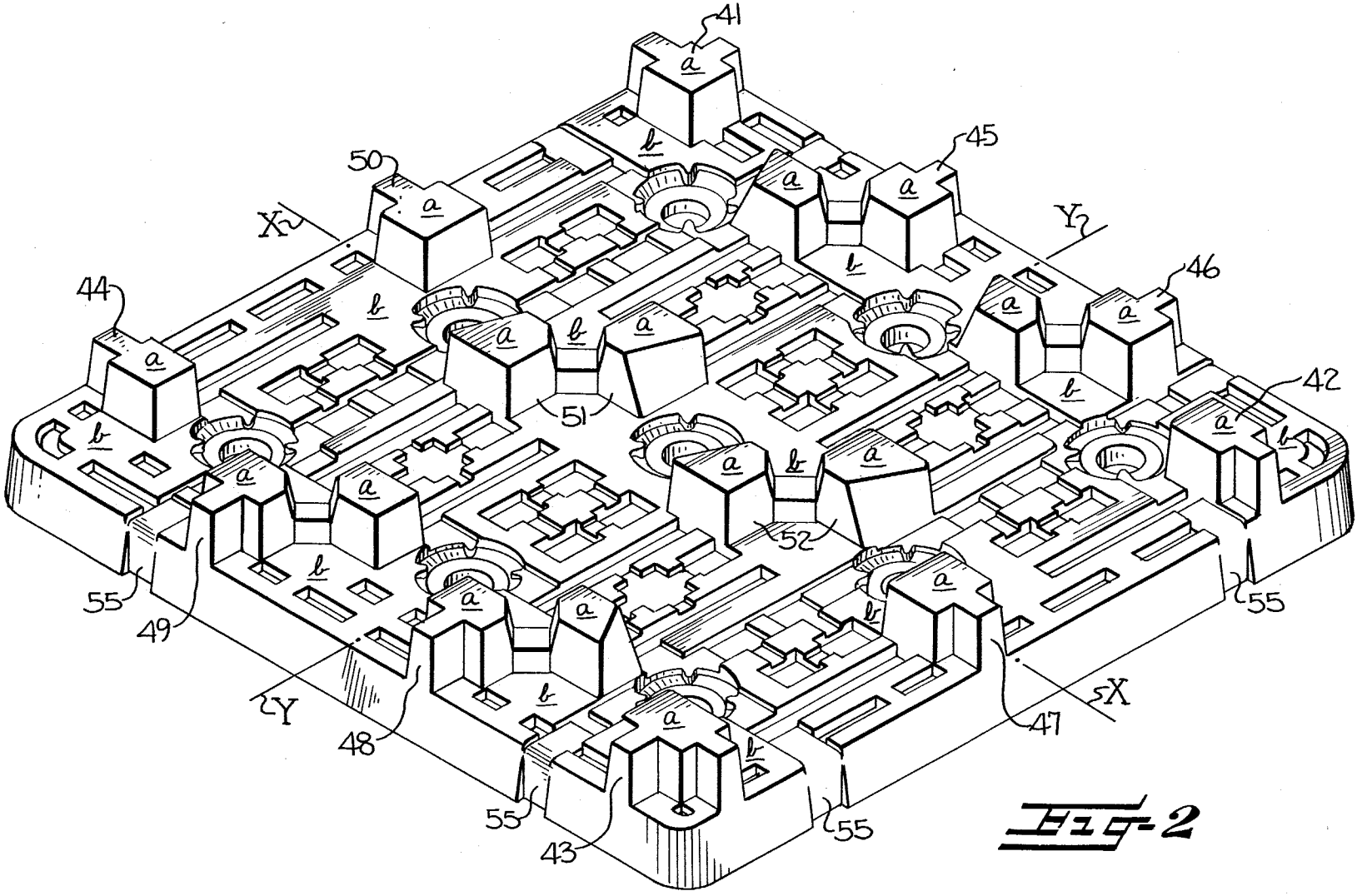
FIG. 2 is a perspective view of the bottom and two sides of the pallet.

As best shown in FIG. 2, the pallet 30 includes a plurality of foot means including corner foot means 41–44, intermediate foot means 45–50, and center foot means 51, 52. It will be observed in FIG. 2 that there are single foot means 47 and 50 positioned between the respective pairs of corner foot means 42, 43 and 41, 44; and there are two foot means 45, 46 and 48, 49 positioned between the respective pairs of corner foot means 41, 42 and 43, 44. Each of the foot means 41–52 comprises at least one projecting member a integral with and projecting downwardly from the base 31, and an adjacent platform member b. In this instance, each of the four corner foot means 41–44 and each of those two intermediate foot means 47 and 50 comprises a single one of the downwardly projecting members a, and each of the remaining foot means 45, 46, 48, 49, 51 and 52 comprises an adjacent pair of the downwardly projecting members a.

Each foot means 41–52 thus, comprises at least one planar platform member b, there being one of the platform members b, formed of the base 31, located closely adjacent the junction of each downwardly projecting member a with base 31.

It is important to note that the downwardly projecting members a are symmetrically disposed with respect to the centerlines of the pallet and that the projecting members on one side of an imaginary center line X—X or Y—Y extending across the pallet 30 (FIG. 2) are arranged in a predetermined offset relation to corresponding projecting members a on the opposite side of such an imaginary center line that is, mirror image relation to the platform members of the corresponding foot means positioned on the opposite side of the centerline so that the pallet 30 when in use in a predetermined position of orientation, and at least another position of orientation 180° out-of-phase therefrom, may be stacked in mating relation to a substantially identical inverted pallet. When thus positioned, it is apparent that the projecting members a of pallet 30 are in abutting relation to the platform members b of the inverted pallet and that interengagement of proximal side surfaces of immediately adjacent projecting members a of pallet 30 and the inverted pallet serve to provide a lateral anti-shift interengagement between the adjacent pallets in a plurality of directions. Such offset arrangement of the projecting members a of the foot means 41–52 is essentially in accord with the arrangement of the foot means described in said U.S. Pat. No. 4,413,737 to which reference is made to avoid unnecessary and excessive description thereof in this context.

Figure 11:
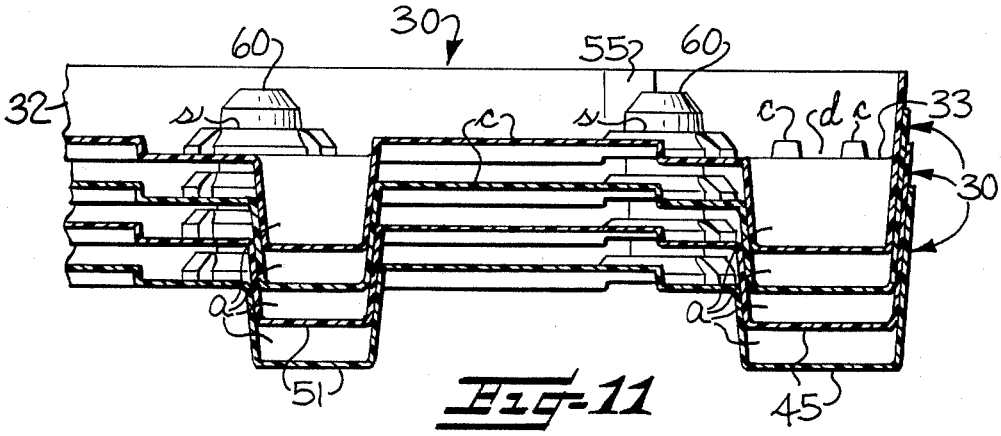
FIG. 11 is a partial sectional view illustrating the nesting capability of adjacent pallets for storage purposes.

It should also be noted, as is evident from the drawings, that the projecting member/platform member pattern of the foot means 41–52 is such as to permit the pallets 30 to be nested with each other when empty, i.e., stacked atop each other with all such pallets facing in the same direction, with a 180° relative rotation between adjacent pallets having no effect on nesting (see FIG. 11). Referring again to FIG. 2, it will be noted that the downwardly projecting members a of the outer foot means 41, 45, and 42 (in that order) and the downwardly projecting members a of the outer foot means 44, 49, 48 and 43 (in that order) are spaced outwardly substantial distances from the downwardly projecting members a of the respective foot means 50, 51, 52 and 47 (in that order) to provide a pair of spaced, substantially parallel, uninterrupted channels or passages therebetween for accommodating fork lift entry at either of two opposite sides of the shipping pallet 30. In this regard, it will be noted that the planar base 31 is provided with a gridwork of a plurality of projecting reinforcing ribs c and valleys d located between and adjacent the various projecting member a, and adjacent the corresponding platform members b, for strengthening those portions of the pallet 30.

In accordance with this invention, it will be observed in FIGS. 1–7, 10 and 11 that each side portion of the upstanding peripheral rim 32 of the pallet 30 is formed with a pair of spaced, inwardly protruding, retaining wedges 55 which extend upwardly and inwardly at an acute angle relative to the peripheral rim, per se, and terminate at the upper edge of the peripheral rim 32 for engagement with the outer surface of a sleeve used in making a shipping container of the pallet 30. The wedges 55 thus aid in holding the corresponding end of the sleeve in predetermined relation to the pallet 30.

Figure 10:
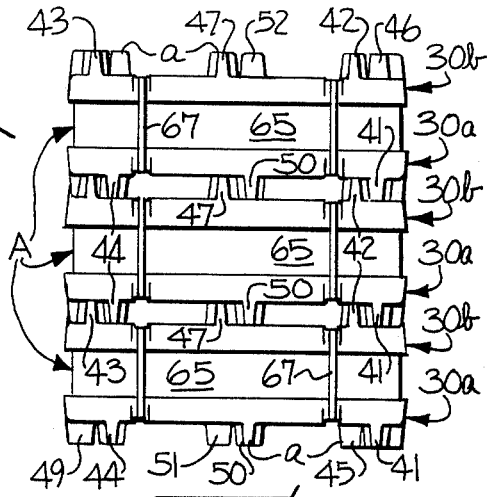
FIG. 10 is a side elevational view of a stack of three shipping containers formed from the pallets and illustrating the foot means of adjacent pallets engaging each other so as to prevent relative lateral shifting of adjacent containers.

The pallet of this invention is particularly devised for accommodating items such as packages of yarn or other strand material having tubular carrier cores around which the yarn or other strand material is positioned. As shown in FIGS. 8, 9 and 10, the pallet of the first embodiment of the invention is particularly adapted to accommodate packages P of yarn or other strand material wound on elongate tubular carrier cores C, which are usually devoid of any end flanges thereon, and wherein the body of the wound yarn usually terminates short of the squared opposite ends of the respective carrier core C.

Figure 1:
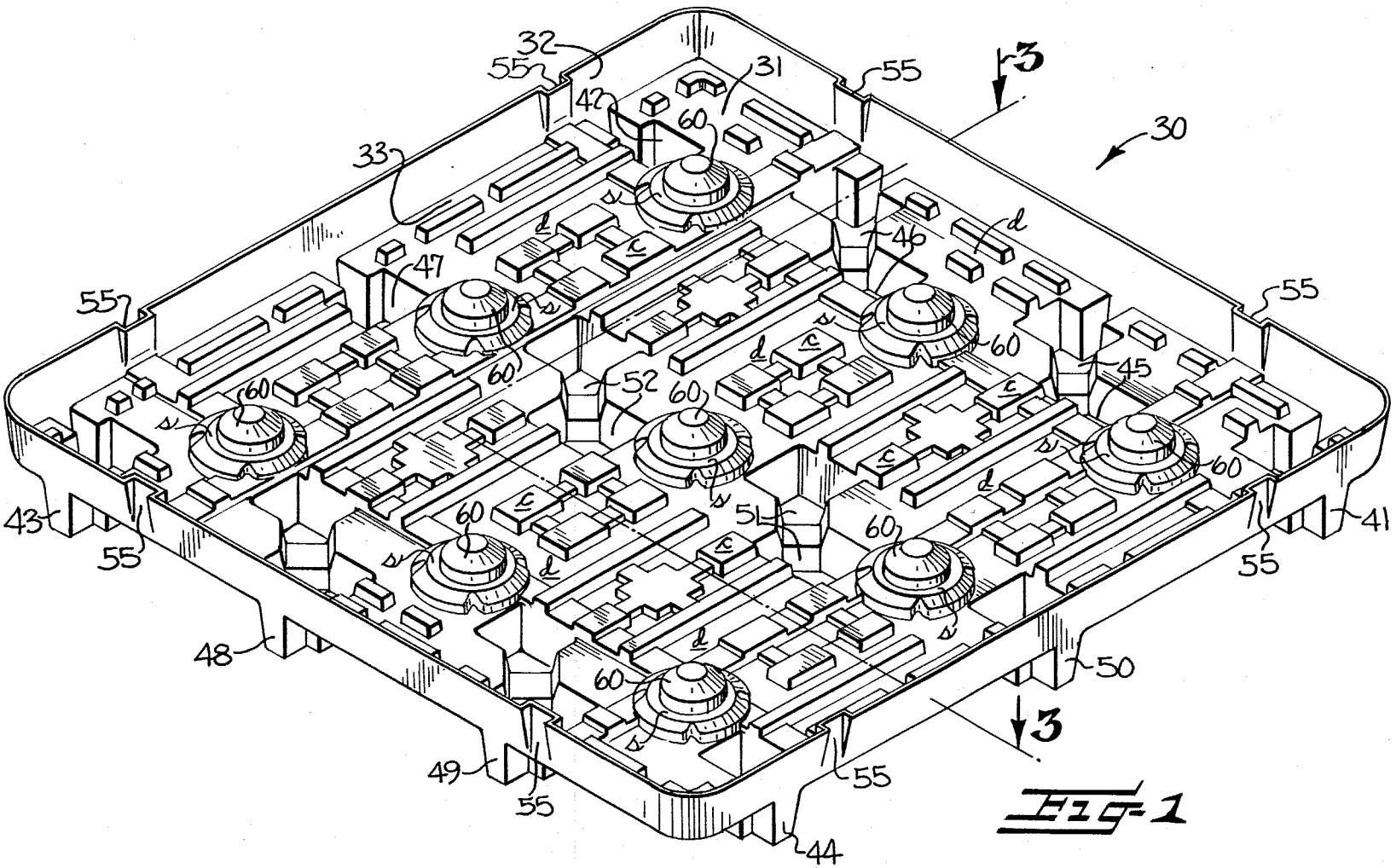
Figure 3:
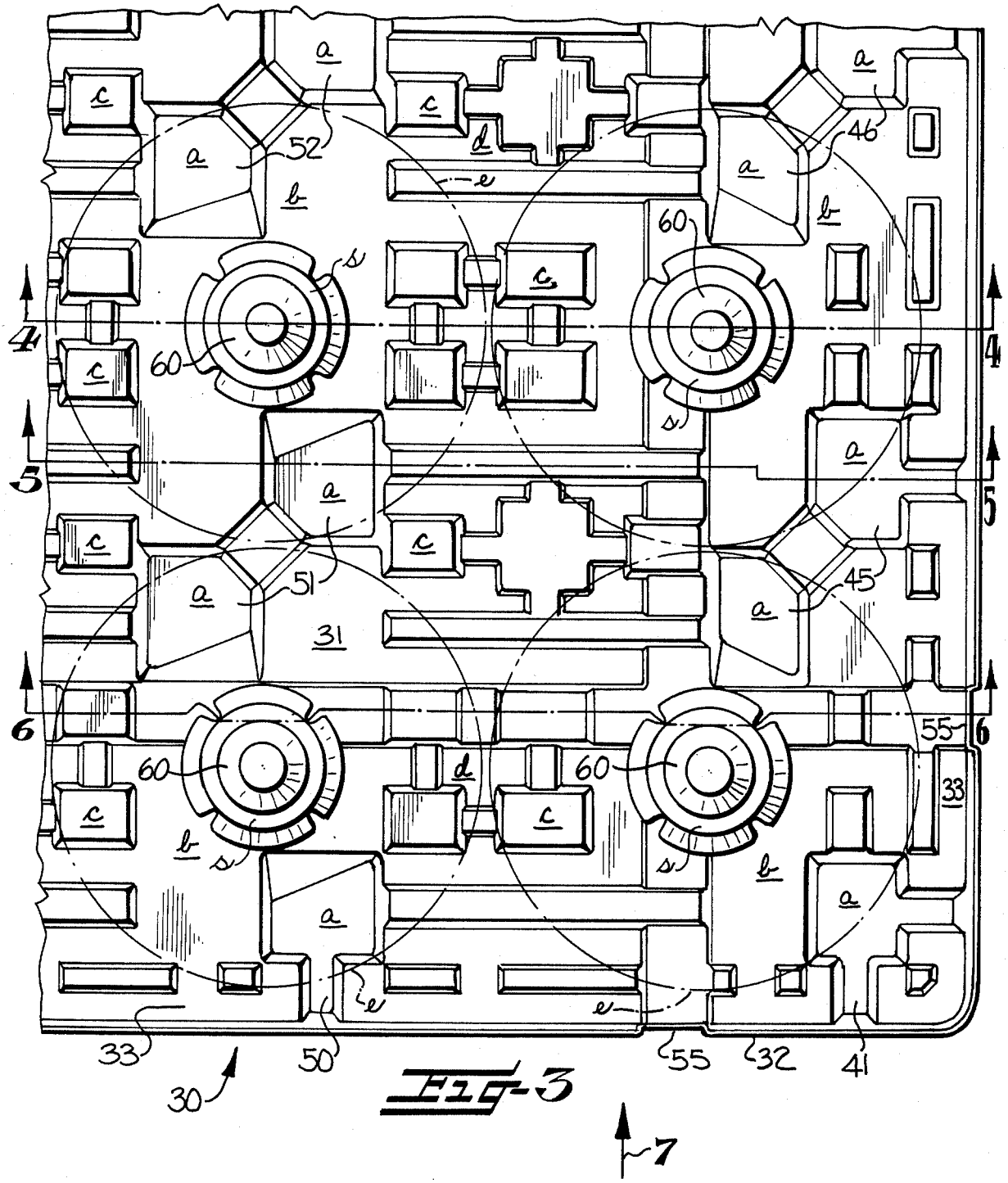
FIG. 3 is an enlarged, fragmentary, top plan view of the area between lines 3—3 in FIG. 1.
Figure 4:
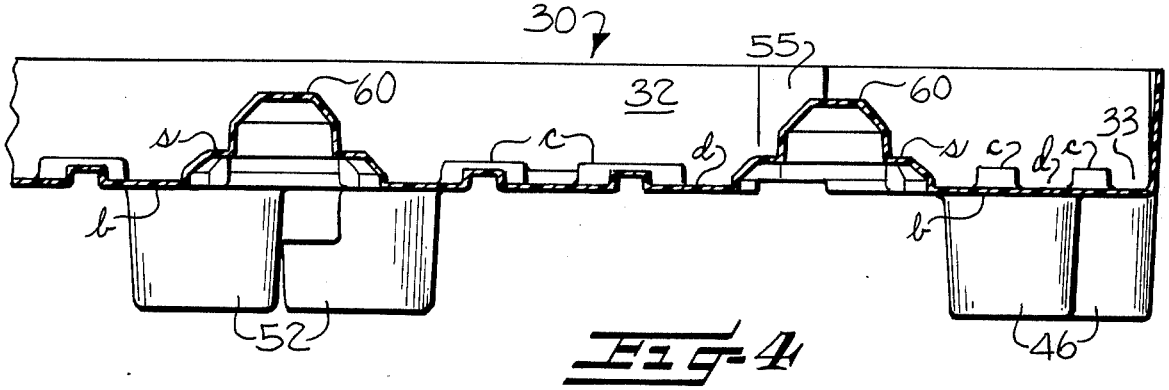
FIG. 4 is an enlarged cross sectional view taken substantially along line 4—4 in FIG. 3.
Figure 5:
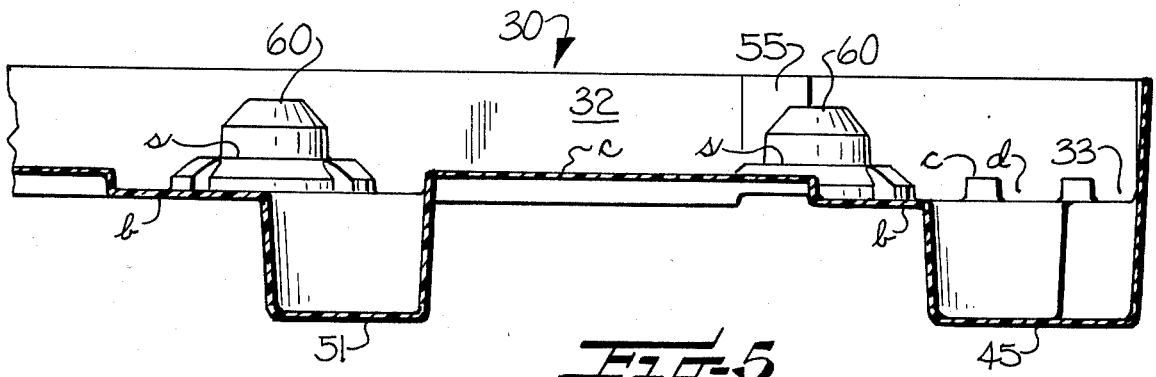
FIG. 5 is a cross sectional view taken substantially along line 5—5 in FIG. 3.
Figure 6:
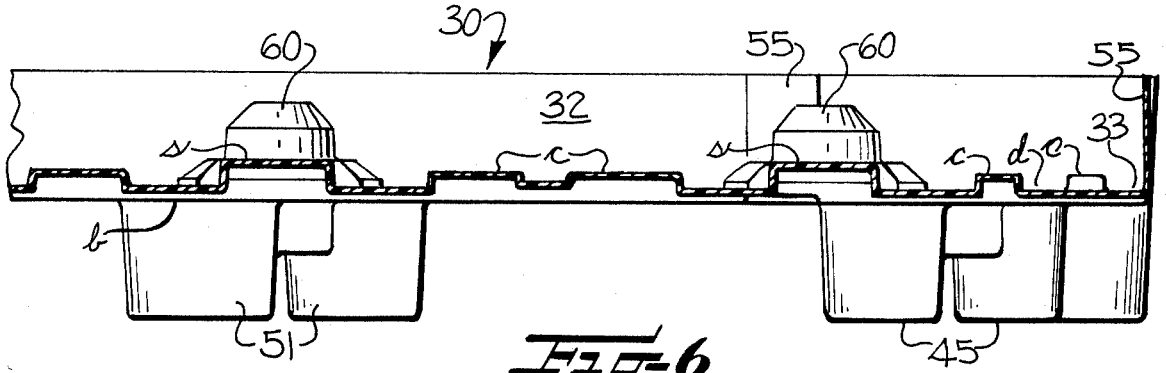
FIG. 6 is a cross sectional view taken substantially along line 6—6 in FIG. 3.
Figure 7:
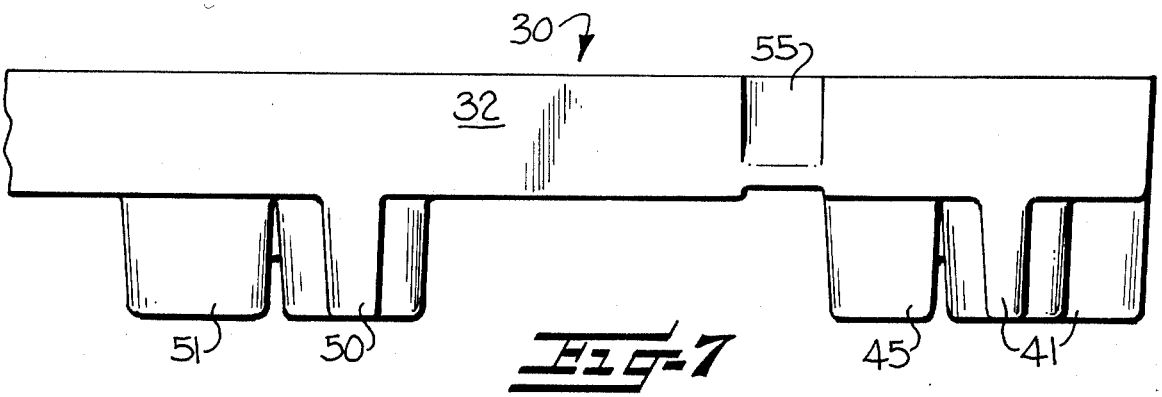
FIG. 7 is an enlarged fragmentary view of the pallet taken looking in the direction of arrow 7 in FIG. 3.

Therefore, in accordance with this invention the pallet of the first embodiment, i.e., pallet 30, is provided with a plurality of rectilinear rows of spaced protuberances 60 extending upwardly from the upper surface of the base 31 for receiving thereon respective items to be stored, transported or shipped and for maintaining such items in a predetermined relationship. As best shown in FIGS. 1 and 3, the rows of protuberances 60 are arranged in lengthwise and widthwise rows with the rows in each direction being substantially parallel to each other. All of the protuberances 60 are of substantially the same size and shape and are uniformly spaced apart from each other. In order to accommodate the tubular carrier cores C of the yarn package P, and to facilitate placing them on the protuberances 60, each protuberance may be of substantially frusto conical shape with a chamferred or rounded off upper free end, substantially as shown.

As heretofore stated, each foot means 41–52 comprises at least one of the downwardly projecting members a and a platform member b adjacent each downwardly projecting member a. Thus, by comparing FIGS. 1, 2 and 3, it can be seen that at least portions of certain of the downwardly projecting members a of the foot means 41–52 are located proximal to each upwardly extending protuberance 60. Further, the last-mentioned portions of the downwardly projecting members a are positioned within imaginary circles e (FIG. 3) all of which are of similar size, and wherein each circle has a diameter no greater than the distance between adjacent protuberances 60 and is circumscribed about substantially the center of each respective upwardly extending protuberance.

Thus, it can be appreciated that the aforementioned portions of the downwardly projecting members a of the foot means 41–52 effect enhanced support for items to be positioned on the protuberances 60 and effect enhanced load distribution for the items positioned on the pallet 30. It is to be noted that, like the projecting members a of the foot means 41–52, the upwardly extending protuberances 60 are also constructed and arranged relative to each other so that the pallet 30 when in use in a predetermined position of orientation, and at least another position of orientation 180° out of phase therefrom, may be stacked in mating relation to a substantially identical inverted pallet, with the projecting members a abutting the platform members b of the inverted pallet and serving to provide a lateral anti-shift interengagement between the adjacent pallets in a plurality of directions. As further shown in FIG. 3, the protuberances 60 closest to the sleeve-receiving groove 33 are spaced from the groove 33 a distance substantially half that of the distance that the protuberances 60 are spaced apart from each other.

Referring now to FIGS. 8 and 9, it will be seen that the pair of lower and upper pallets 30*a* and 30*b*, which are identical to the pallet 30 of the first embodiment of this invention, serve as the bottom and top, respectively, of the shipping container A. The container further comprises a sleeve member 65 providing a set of load-enclosing walls between the lower and upper pallets 30*a* and 30*b*.

The lower and upper end portions of sleeve member 65 are seated in peripheral sleeve-receiving grooves 33 and fit inwardly of the peripheral rims 32 of the respective lower and upper pallets 30*a*, 30*b*. Also, as indicated earlier herein, the inwardly protruding wedges 55 (FIGS. 1 and 2) on the peripheral rim 32 of each pallet frictionally engage the outer surfaces of opposite end portions of the sleeve member 65 to aid in maintaining the sleeve member 65 in proper engagement with the lower and upper shipping pallets 30*a*, 30*b* (see FIG. 12). In this regard, it is to be noted that the wedges define respective notches or grooves facing outwardly on each side portion of the peripheral rim 32 of each pallet (FIGS. 1, 2 and 12). These notches serve as guides for receiving pliable means for securing the pallets 30*a* and 30*b* and the sleeve member 65 (FIGS. 8 and 9) together after the items or yarn packages P have been placed on the bottom pallet 30*a* and the upper pallet 30*b* has been placed upon the upper ends of yarn packages P. Such pliable means is shown in FIG. 8 in the form of binder strap members 67.

It will be noted that the container A includes but a single layer of yarn packages P. However, a container having a plurality of superposed layers therein can also be constructed utilizing pallets of the present invention, as will be later described. The manner in which the yarn packages are arranged on the bottom or lower pallet 30*a* of FIGS. 8 and 9 will now be described.

As best shown in FIG. 9, the upwardly extending protuberances 60 of the pallets 30*a*, 30 *b* are of such shape and size as to receive thereon specific individual items such as the yarn packages P, best illustrated in FIG. 9. As shown in detail in this figure, the protuberances 60 are desirably molded to a size which matches the inside diameter of the tubular carrier cores C of the yarn packages P. Thus, when the yarn packages P are placed on the protuberances 60, the engagement of the protuberances 60 with the carrier cores C aids in maintaining each package P in a predetermined location and in a predetermined relation to the other packages placed on the pallet 30*a*.

As further illustrated in FIG. 9, when an identical pallet 30*b* is inverted with respect to the pallet 30*a* upon which a single layer of yarn packages P is placed, and used to form the top of a shipping container A, the protuberances 60 of the pallet 30*b* similarly interengage with the carrier cores C of the packages P. As shown in FIG. 9, the protuberances 60 of the top pallet 30*b* engage the ends of the tubular carrier cores C opposite from those ends engaged by the protuberances 60 of the bottom pallet 30*a*.

Thus, a shipping container may be formed in which both the bottom pallet 30*a* and the top pallet 30*b* define a position for, and maintain the position of, individual items within the shipping container in a predetermined relationship.

In the use of the first embodiment of the pallet, the arrangement of the protuberances 60 serves the additional function of preventing abrasion of individual items, such as yarn packages P, with the base 31 of either pallet 30*a* or 30*b*. As shown in FIGS. 1, 2 and 3 and as illustrated in greater detail in FIGS. 4, 5, 6 and 9, the base 31 of the pallet 30, while being generally planar in over-all structure, has a substantial amount of gridwork of the rib and valley portions c, d for increasing the structural strength and rigidity of the pallet. In order to prevent the abrasion of individual yarn packages P against the rib portions c of the gridwork, the protuberances 60 are provided with respective shoulder means s (FIGS. 4, 5, 6 and 9). As shown, the shoulder means s have respective upper or outer surfaces thereof located futher outwardly away from the body of the base 31 (as represented by the rib portions c) of each respective pallet. Thus, when the tubular carrier core C of a yarn package P or the like is positioned in engagement with a protuberance 60 of a pallet, such as pallet 30*a* in FIG. 9, the corresponding end of the tubular carrier core C impinges against or rests upon the respective shoulder means s as opposed to impinging against any of the adjacent rib portions c of the corresponding base 31.

As illustrated in FIG. 9, when yarn packages P are properly mounted on a pallet or between a pair of pallets, such as the pallets 30*a*, 30*b*, the tubular carrier cores C bear against the shoulder means s of the corresponding protuberances 60. Since the outer surfaces of the shoulder means s are spaced outwardly away from the bodies of the bases 31 of the pallets 30*a*, 30*b* it can be appreciated that the yarn packages P are spaced away from the bodies of the bases 31. Such spaced relationship further aids in preventing damage to the yarn on the yarn packages P by abrasion.

As further shown in FIG. 9, the yarn wound on each tubular carrier core C is spaced inwardly from each end of the respective core C, as is generally the case. Consequently, the spaces or distances between the yarn and the respective bases of the pallets 30*a*, 30*b* shown in FIG. 9 are somewhat greater than would be the case if the yarn extended the entire length of each core C. However, even if the yarn or other strand material were to extend the entire length of each carrier core C, it is apparent that the yarn still would be spaced away from the outer surfaces of the adjacent rib portions c of the bases 31, so as to prevent the individual yarn packages from damage by abrasion.

From the foregoing description, it is apparent that the shipping container A of FIGS. 8 and 9 may be constructed by positioning the cores C of the packages P on the protuberances 60 of the lower shipping pallet 30*a*, substantially as described heretofore. The upper pallet 30*b* then may be placed upon the thus formed single layer of yarn packages P with the protuberances 60 of the upper pallet 30*b* positioned in the upper ends of the respective carrier cores, and with the sleeve member 65 positioned between the pallets 30*a* in the manner heretofore described. Thereafter, the packages P and the pallets 30*a*, 30*b* are firmly secured together, as shown in FIGS. 8 and 9, by the binding strap members 67.

As shown in FIG. 10, a plurality of containers A may be formed as described above, and then may be stacked in subtantially uniform vertical alignment. Since the projecting members of the foot means 41–52 (FIG. 2) of adjacent pallets in the stack of FIG. 10 are in mating relationship, it is apparent that all the containers A in the stack of containers are substantially prevented from shifting laterally in any direction relative to each other to maintain the items in each container, and all the containers, in a predetermined relationship.

Referring now to FIG. 12–15, there is shown one way in which a container similar to container A may be constructed, according to this invention, to contain a load of a plurality of layers of items, such as the yarn packages P. To this end, it will be seen in FIG. 12 in particular, that where such a container, broadly designated at D, is adapted to carry a plurality of layers of items, the items on one layer will be maintained in a predetermined relationship by the protuberances 60 on the bottom pallet 130*a*. Similarly, the items on another layer, shown in FIGS. 12–15 as yarn packages P, will be maintained in a predetermined relationship by the protuberances 160 on the top pallet 130*b*.

Certain elements shown in FIGS. 12–15 which are identical to or similar to elements shown in FIGS. 8–10, will have the same identifying numeral with the prefix "1" added to avoid repetitive description, where applicable.

In order to stabilize proximal portions of any adjacent layers in a container D having more than one layer of yarn packages P or similar items therein and to maintain those items in a predetermined relationship, there are provided stabilizing means located between and cooperating with adjacent layers of individual items to aid in maintaining the load of individual items in a predetermined relationship within the container D. The drawings illustrate two types of such stabilizer means. FIGS. 12–15 illustrate a first type comprising a substantially planar member 131 with a plurality of spaced protuberances 160' extending outwardly from opposite sides of the planar member 131.

Figure 15:
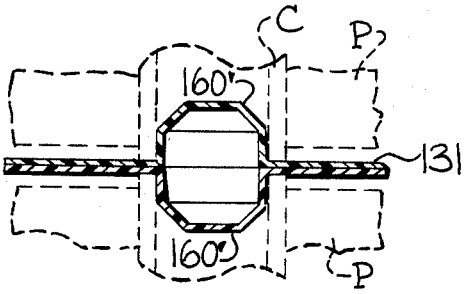
FIG. 15 is an enlarged cross sectional view of a stabilizer means and being taken substantially along line 15—15 in FIG. 12.

It will be observed in FIGS. 14 and 15 that the protuberances 160' are substantially axially aligned with each other on opposite sides of each planar member 131. It is apparent that the protuberances 160' are arranged on each planar member 131 in substantially the same spaced relationship as, and in substantially the same pattern as, the protuberances 160 on the pallets 130*a*, 130*b*. By the same token, the stabilizing protuberances 160' are of substantially the same shape and size as the protuberances 160, in this instance.

As shown in FIGS. 12, 14 and 15, when one of the planar members 131 is placed between respective adjacent layers of yarn packages P, and in generally parallel relationship to the pallets 130*a* and 130*b*, the protuberances 160 are received within the tubular carrier cores C of the yarn packages P. The downwardly facing protuberances 160 of a planar member 131 thus aid in stabilizing the upper portions of the carrier cores C of the respective lower layer of yarn packages P and the upwardly facing protuberances 160 aid in stabilizing the lower portions of the carrier cores C of the respective upper layer of yarn packages P.

It will thus be seen that, in a shipping container D formed from pallets 130*a* and 130*b*, peripheral sleeve 165 and planar members 131, there exists a cooperation between the protuberances 160 of the pallets 130*a* and 130*b*, the protuberances 160' of one or more planar members 131 (depending upon the number of layers of yarn packages in the container) and the tubular carrier cores C of the yarn packages P, which serves to maintain all of the individual items in each layer in a predetermined relationship within the container D. As pointed out earlier herein, it is desirable that such a predetermined relationship among the individual items be maintained in order to prevent the damage that could occur to the items should relative movement of the items take place within the shipping container.

Figure 16:
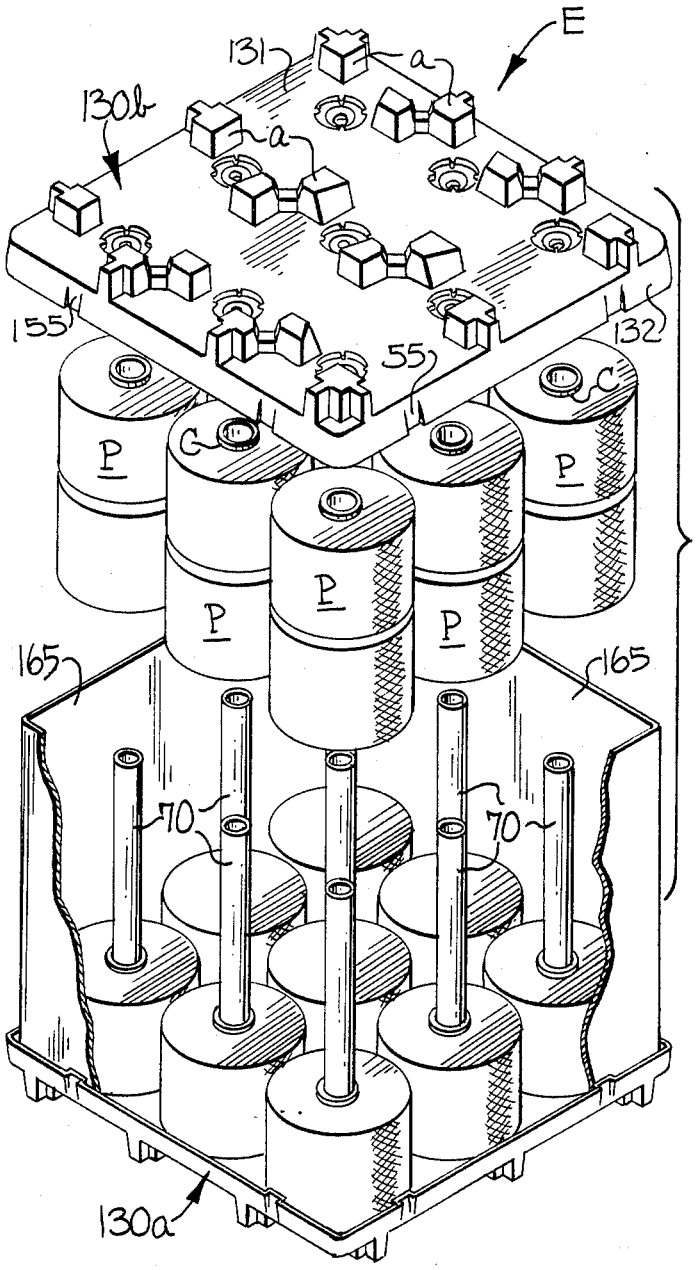
FIGS. 16, 17 and 18 are views similar to the respective FIGS. 12, 13 and 14, but showing a modified form of stabilizer means for maintaining multiple layers of items in the desired predetermined relationship.
Figure 17:
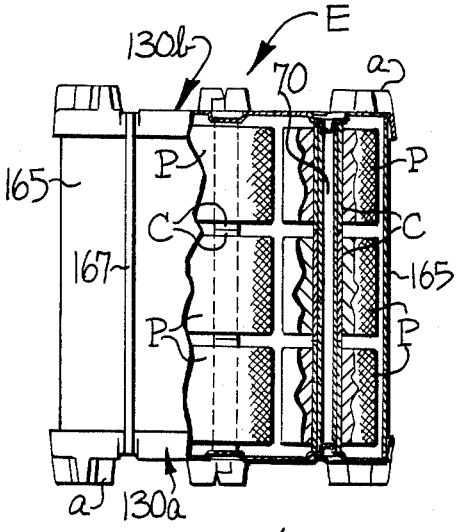
Figure 18:
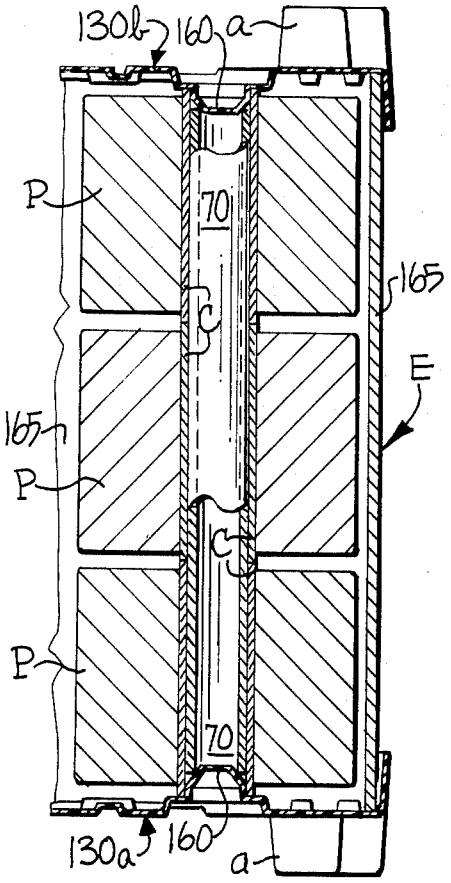

The container E shown in FIGS. 16–18 is generally similar to the container D shown in FIGS. 12–15. Accordingly, the same reference characters will apply to similar parts in FIGS. 16–18 as are applied in FIGS. 12–15, where applicable, to avoid repetitive description.

The container E of FIGS. 16–18 differs from D shown in FIGS. 12–15 in that a second type of stabilizer means; that is, elongate members illustrated as tubes 70 in FIGS. 16–18, extend between the bottom and top pallets 130*a* and 130*b*, and within the tubular carrier cores C of the yarn packages P of the several layers of yarn packages within the shipping container E. As can be seen in FIGS. 17 and 18, the protuberances 160 of the bottom pallet 130*a* serve to maintain the lower portions of the yarn packages of the bottom layer in their predetermined relationship, and the protuberances 160 of the top pallet 130*b* serve to maintain the upper portions of the yarn packages of the top layer in their predetermined relationship. The tubes 70 extend substantially the entire distance between the bottom and top pallets 130*a* and 130*b* and within the tubular carrier cores C of the yarn packages P of all of the several layers. Thus, the protuberances 160, the tubes 70 and the carrier cores C cooperate to maintain all the yarn packages P in all the layers in predetermined relationship.

It can be seen in FIGS. 17 and 18 that the ends of the elongate members or tubes 70 are aligned with the corresponding protuberances 160 on the lower and upper pallets 130*a*, 130*b* and within the tubular carrier C of the load of items for interconnecting the items of each layer with items in adjacent layers for aiding in maintaining the items of the load in a predetermined stabilized relationship within the container D. It will be noted that the elongate members or tubes 70 also serve to hold the packages P in vertical columnar formations, i.e., all those items positioned on any single one of the tubes 70 are maintained in substantially axial or vertical alignment with each other by the respective tube 70, per se.

(Second Embodiment of the Invention)

Figure 20:
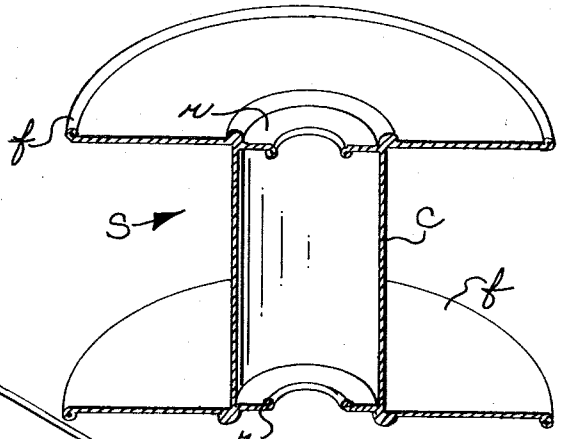
FIG. 20 is a perspective view partially in cross section and showing a flanged reel such as may be carried on the pallet of FIG. 19.
Figure 19:
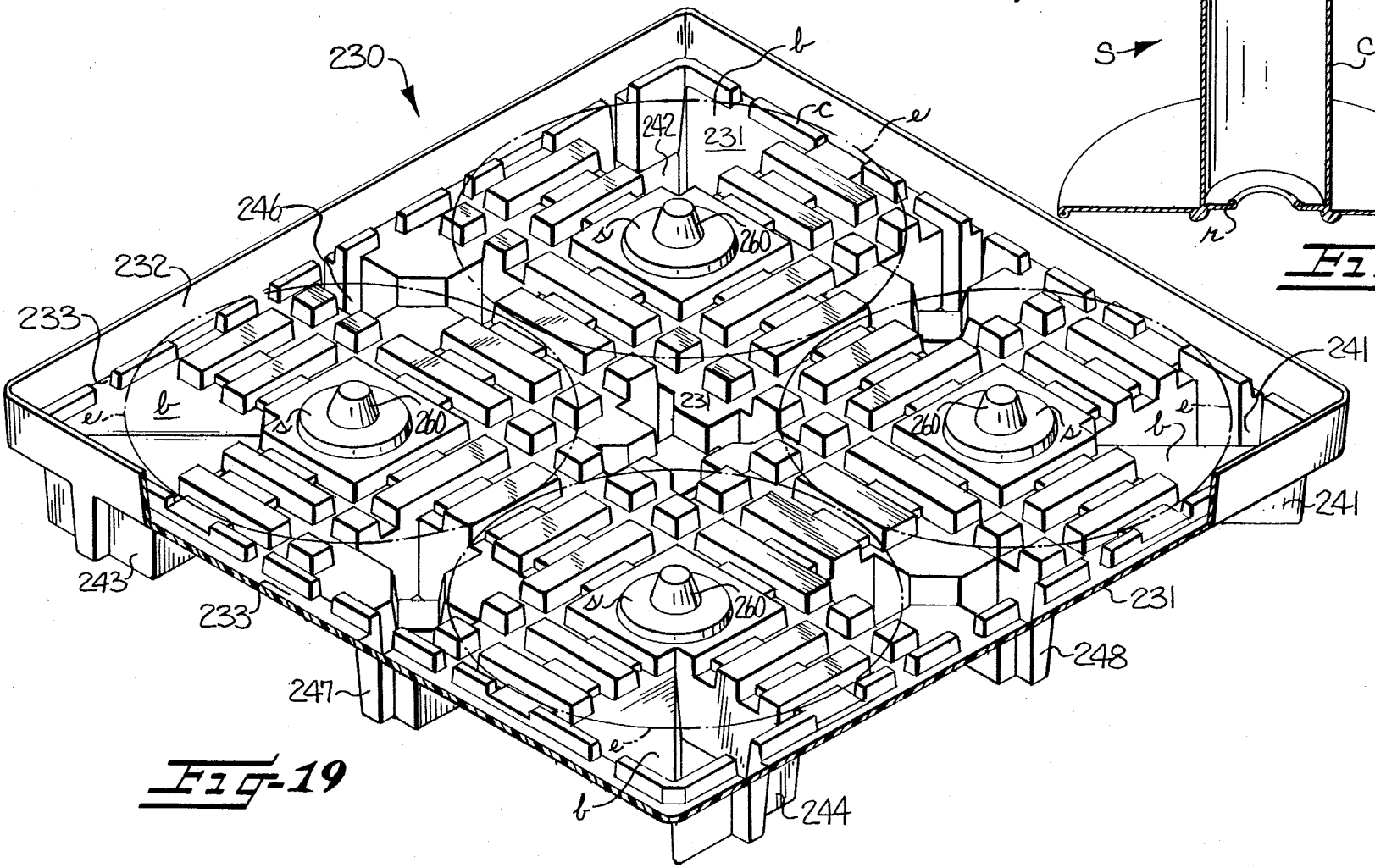

In many respects the second embodiment of the pallet, shown in FIGS. 19 and 20, and the containers shown in FIGS. 22–28 are generally similar to the first embodiment illustrated in FIGS. 1–18. Accordingly, those elements of the second embodiment of the invention, FIGS. 19–28, which are similar to the first embodiment of the invention, will bear the same reference characters with the prefix "2" applied thereto to avoid repetitive description.

There is provided a second embodiment of the invention having all of the advantages of the first embodiment in that the second embodiment is similarly self-nesting with other identical pallets when empty and suitable for forming shipping containers which are stackable and have anti-shifting capabilities when stacked, as described earlier herein with reference to containers formed from the first embodiment of the invention. The second embodiment, however, is adapted to carry a somewhat different type of individual item, in particular strand material, such as wire, which is packaged on flanged spools S having carrier cores rather than unflanged tubular carrier cores. In such a case it is still desirable that the pallet and protuberances establish and maintain a predetermined position for each item and a predetermined relationship among the items on the pallet and in the container, and that the foot means provide localized support to the items on particular protuberances.

The flanges of spools S of this type offer sufficient protection to the ends of the material packaged on the spools. Further, in such cases it may not be necessary that the material on the periphery of the spools be otherwise protected, as were the periphery of yarn packages by the spacing of the protuberances 60 of the pallet 30 of the first embodiment of the invention. Rather, in such cases it is desirable that the pallet support both the core and the flange portions of the spool in order to enhance both the carrying capability and the shipping capability of the pallets and of the shipping containers made therefrom. Thus, in the first embodiment of the pallet 30, the shoulder means s were adapted to carry and maintain a yarn package having a tubular carrier core in a spaced relationship to the rib portions of the base 31 and thereby protect the ends of the package from abrasion and consequent damage. Alternatively, in the second embodiment of the invention, the relationship between the protuberances, and the rib portions of the base 231 is such that a flanged spool placed on and supported by a protuberance is also additionally supported by the rib portions c of the base 231 surrounding a protuberance.

In FIG. 19, the pallet of the second embodiment is broadly designated at 230. In the particular configurations of the pallet illustrated by FIG. 19 and the following figures, there are four protuberances 260 arranged in two rectilinear rows of two protuberance each. The protuberances 260 are adapted to receive thereon flanged spools S of strand material such as spools of wire. FIG. 20 is a perspective, cross sectional view of a typical empty flanged spool, S.

Figure 21:
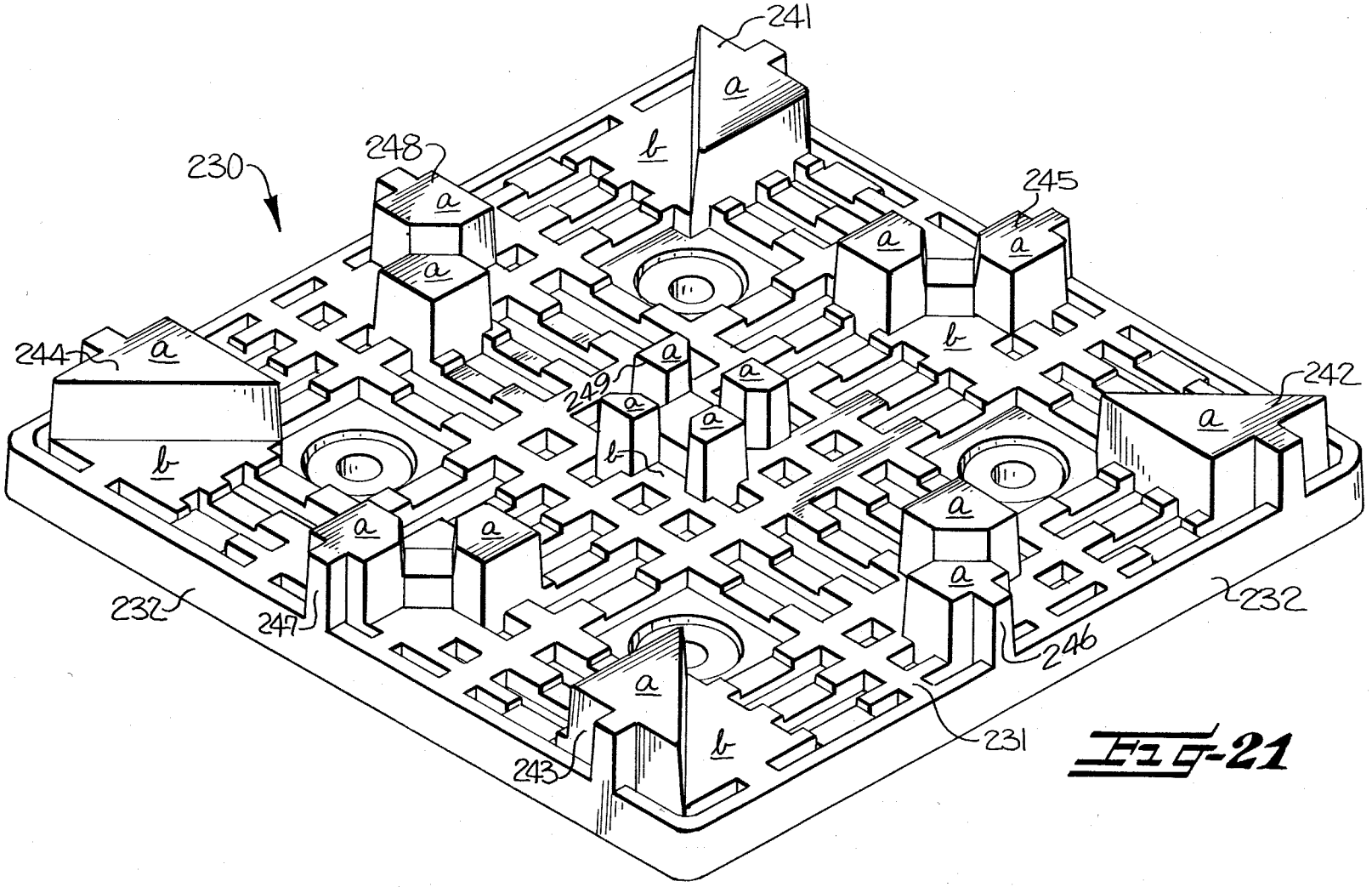
FIG. 21 is a perspective view of the bottom and two sides of the second embodiment of the pallet of this invention.

As best shown in FIG. 21, the pallet 230 includes a plurality of foot means including corner foot means 241–244, intermediate foot means 245–248, and center foot means 249. Each of the foot means 241–249 comprises at least one projecting member a integral with and projecting downwardly from the base 231, and an adjacent platform member b. In this instance, each of the four corner foot means 241–244 comprises a single one of the downwardly projecting members a, and each of the remaining foot means 245, 246, 247, 248, and 249 comprises an adjacent pair of the downwardly projecting members a.

Each foot means 241–249 further comprises at least one planar platform member b, there being one of the platform members b, formed of the base 231, located closely adjacent the juncture of each downwardly projecting member a with base 231.

Figure 23:
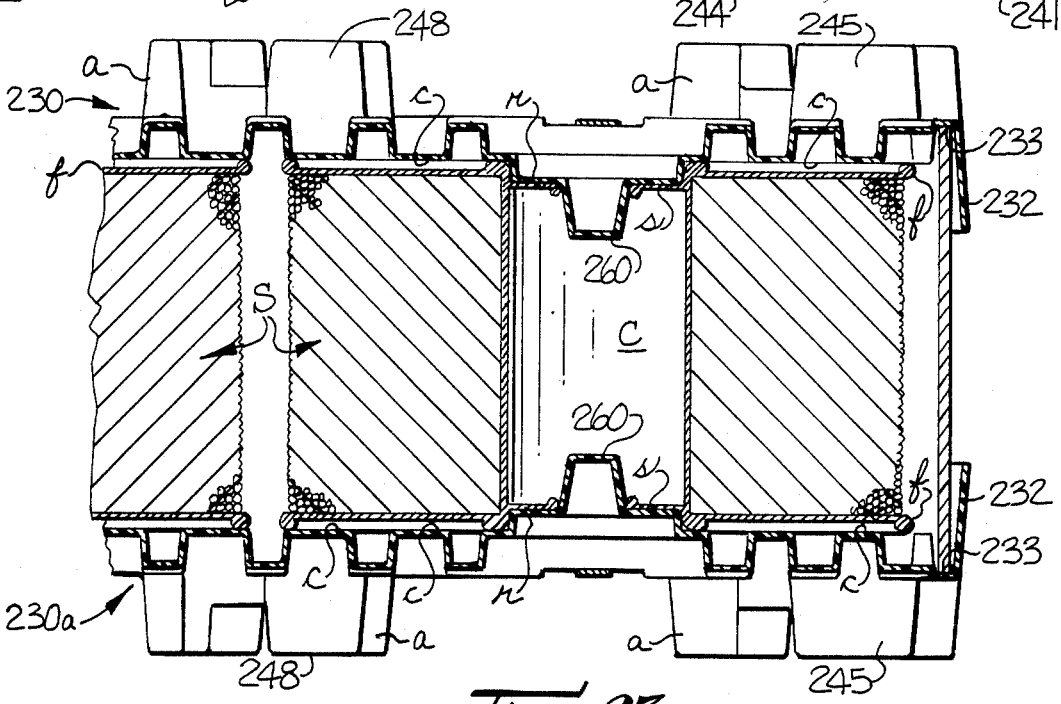
FIG. 23 is a partial cross-sectional view taken substantially along line 23—23 of FIG. 22 and showing portions of two individual flanged items maintained in relative positions by the protuberances on the pallets.
Figure 25:
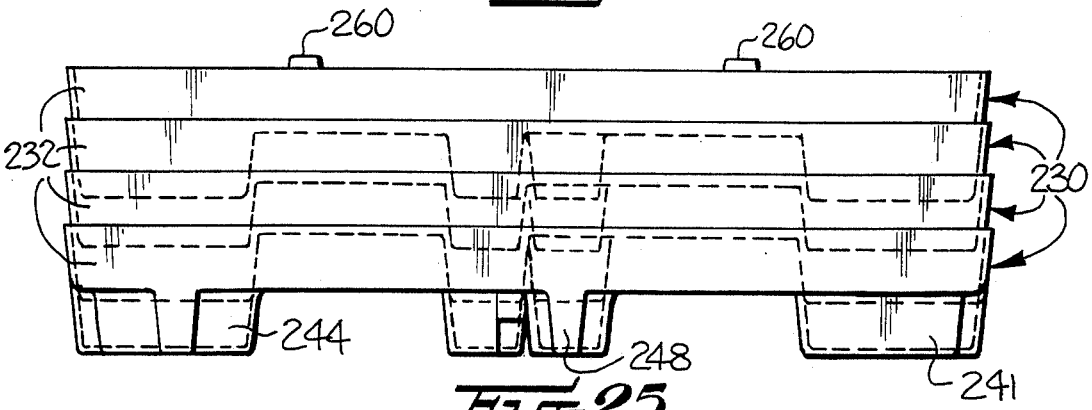
FIG. 25 is a side elevational view of a nested stack of several empty pallets of the second embodiment and omitting, for the purpose of clarity, many of the relatively smaller details of the pallets.

As in the first embodiment of the invention, the foot means of the second embodiment are likewise so positioned as to enhance the support of the flanged spools placed on the protuberance of the pallet. In this regard, and as best illustrated in FIG. 23, the foot means 241–249, are positioned so that at least portions of each of the downwardly projecting members a, respectively, are located proximal to each upwardly projecting protuberance 260. The proximity of the projecting members a to the protuberances 260 is such that, as in the first embodiment, portions of the projecting members will always fall within respective imaginary circles e (See FIG. 21) circumscribed around the center of each protuberance 260; each circle being of the same diameter, in particular a diameter no greater than the distance between adjacent protuberances. In this manner, and similar to the first embodiment, when individual items are placed upon the protuberances 260, their respective weight will always be at least partially transferred to an adjacent foot means and in no case will an item located on a protuberance lack at least the partial support of portions of the foot means. This relationship between foot means and protuberances enhances the load distribution of the pallets and of the shipping containers formed therefrom.

The second embodiment is further constructed so that the protuberances are generally frusto conically shaped and have shoulder means thereon as the protuberances 60 of the first embodiment of the pallet 30. These shoulder means are designated at s in FIG. 19 and serve to restingly receive thereon the carrier cores C of the individual items to be shipped. Because the second embodiment is arranged to carry flanged spools S of strand material, the shoulder means s are provided with an upper surface which may be on substantially the same level as that of the upper surface of base 231. As illustrated in FIG. 23, the shoulder means s is on a somewhat higher level than the upper surface of base 231 to accommodate the recessed end portion r of the carrier core C of the flanged spool S. Consequently, when the carrier cores C of the flanged spools S rest on the protuberances 60, the outer portions of the flange f similarly rest on certain portions of the portions of the base 231.

FIG. 23 is a cross sectional view of a shipping container F formed form two of the pallets **230*a* and 230*b* of the second embodiment and a single layer of flanged spools S of strand material. As seen in FIG. 23, no spaced relation exists between the end portions of the flange f and the base 231, as existed between yarn package P and the base 31 of the first embodiment of the pallet 30. Rather, and as is desired in this embodiment, in addition to resting on the shoulder means s of the protuberances 260, the flanged spools S also rest on certain portions of the base 231 at several radially outwardly positioned locations. Thus, the flanged spools S are supported on the pallet by both the shoulder means of the protuberances and by certain portions of the base 231**.

As in the first embodiment, the pallet 231 includes a peripherial exterior rim 232 which projects generally upwardly perpendicular to the base 231. As best shown in FIG. 19, a peripheral sleeve-receiving groove 233 is provided between the rim 232 and the portion of the base 231 surrounded thereby.

Figure 22:
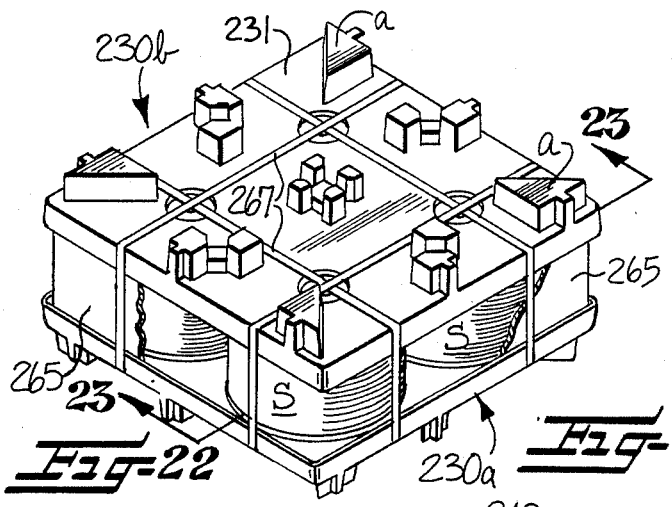
FIG. 22 is a partially cut away perspective view of a shipping container formed from two pallets of the second embodiment of the invention and a single layer of individual flanged items and omitting, for the purpose of clarity, many of the relatively smaller details of the pallets.
Figure 24:
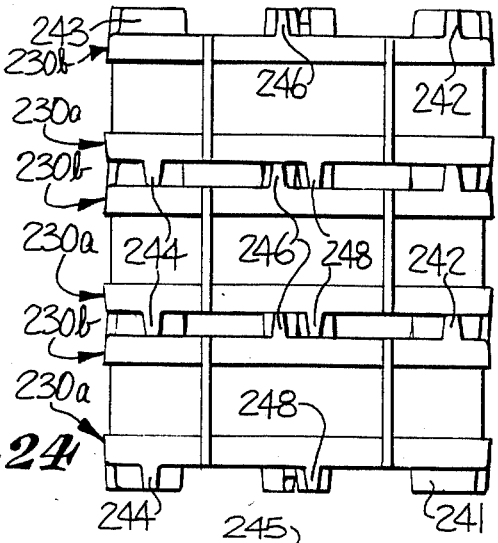
FIG. 24 is a side elevational view of a stack of three of the containers of FIG. 22 and showing the interengagement of the adjacent pallets.

As is the case in my patented pallet and in the first embodiment of the pallet of the present invention, a second embodiment of a shipping container such as those illustrated in FIGS. 22–24, may be formed from a pair of pallets **230*a* and 230*b* of the present embodiment, a peripheral sleeve 265 to form load bearing side walls, and means such as the binder straps 267** to fasten the pallets and sleeve into an integral container.

As shown generally in FIG. 22, and in more detail in FIG. 23, and in a manner similar to the use of the first embodiment, when a container F is formed from two pallets, a sleeve, and a single layer of individual items, the protuberance 260 on the lower pallet **230*a* are arranged in substantial alignment with the respective protuberance 260 on the upper pallet 230*b*** and respective opposite protuberances are received into opposite ends of the carrier cores C of the flanged spools S. In this manner, the container formed from the pallets aids in maintaining the load of flanged spools S in a predetermined relationship within the container.

Similarly, a shipping container for carrying a plurality of layers of individual items may be formed from pallets of the second embodiment of the invention. In FIGS. 26–28 such a container G formed from the second embodiment of the pallet, is shown carrying three layers of flanged spools S. As in the case where a plurality of layers of items was carried in a shipping container made from pallets of the first embodiment of the invention, items not adjacent to either the top or bottom pallet cannot be directly maintained in position by the protuberances 260 of a pallet 230. Consequently in such containers, additional means for stabilizing the intermediate layers not adjacent to a pallet are desirable. In the second embodiment of the shipping container of the invention, these stabilizing means are in the form of a plurality of individual adapters 80, each adapter comprising a body portion with opposing protuberances thereon. In FIG. 29 such an adapter 80 is shown as having a circular disc body portion 81 and opposing frusto conical protuberances 82 extending perpendicularly to and in opposite directions from the body portion 81. As shown in FIGS. 26 and 28, the body portion 81 and the opposing protuberances 82 are arranged to fit within the ends of the carrier cores C of the flanged spools S. As a result, when one such adapter is positioned between each adjacent pair of flanged spools S, in respective adjacent layers, the cooperation between the probuberances 260 on the pallet 230, the carrier cores C and the adapters 80 serve to stabilize the entire load of items and maintain the items in the desired predetermined relationship within the container.

Although of partially different shape from those of the first embodiment of the pallet, (See FIG. 21) the foot means 241–249 of the second embodiment of the pallet likewise interengage and about one another when containers made from the pallets of the second embodiment are stacked, as illustrated in FIG. 24. As in the previous embodiment, this arrangement of the foot means 241–249 prevents lateral shifting in a plurality of directions. Further, depending on the overall size of the pallet, a pair of spaced, substantially parallel uninterrupted channels are provided between the foot means for accommodating fork lift entry at either of two opposite sides of the pallet 230 and respective stacked containers made therefrom.

In the drawings and specification, there have been set forth preferred embodiments of the invention, and although specific terms are employed, they are used in a generic and descriptive sense only and not for purposes of limitation.

That which is claimed is:

1. A shipping pallet of unitary construction and adapted for use with another substantially identcal pallet so as to serve as a bottom or top wall of a shipping container for transporting and storing a load, said shipping pallet having a generally planar base having an outer peripheral rim extending generally upwardly relative to said base and wherein a sleeve receiving groove extends alongside of and is surrounded by said rim, a plurality of spaced protuberances extending upwardly from the upper surface of the base for receiving thereon respective items to be shipped and for maintaining such items in a predetermined relationship, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding platform member adjacent the base of each projecting member, the construction and location of each of said projecting members and corresponding platform members being such that each projecting member is adapted to be abuttingly engaged by a corresponding platform member of another pallet and to provide a lateral anti-shift interengagement between adjacent pallets when the pallets are used as tops and bottoms for shipping containers in stacked condition, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers using this pallet construction and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet.

2. A shipping pallet according to claim 1, wherein shoulder means is provided adjacent the lower portion of each of said protuberances for restingly receiving thereon the item to be shipped, said shoulder means having an upper surface on a level above that of said base for maintaining the items positioned on the protuberances in spaced relation from said base.

3. A shipping pallet according to claim 1 wherein shoulder means is provided adjacent the lower portion of each of said protuberances for restingly receiving thereon the item to be shipped, said shoulder means having an upper surface on substantially the same level as that of said base, and said reinforcing gridwork having portions thereof arranged to provide support to items resting on said shoulder means at a plurality of spaced apart locations on radii extending radially outwardly in various directions from substantially the center of each protuberance.

4. A shipping pallet according to claim 1 wherein said protuberances are frusto conically shaped for guidingly receiving the items to be positioned thereon.

5. A shipping pallet according to claim 1 wherein said rim has a substantially planar inner substantially vertical surface, and means interrupting and extending inwardly from said planar inner vertical surface and adapted to frictionally engage a sleeve positioned in said sleeve receiving groove for aiding in maintaining such sleeve in groove.

6. A shipping pallet of unitary construction and adapted for use with another substantially identical pallet so as to serve as a bottom or top wall of a shipping container for transporting and storing a load, said shipping pallet having a generally planar base having an outer peripheral rim extending generally upwardly relative to said base and wherein a sleeve receiving groove extends alongside of and is surrounded by said rim, a plurality of parallel rows of spaced protuberances extending upwardly from the upper surface of the base for receiving thereon respective items to be shipped and for maintaining such items in a predetermined relationship, said rows of protuberances being arranged in lengthwise and widthwise rows, with said rows in each direction being parallel to each other, said protuberances all being of substantially the same size and shape and substantially uniformly spaced apart from each other, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot comprises at least one downwardly projecting member and a corresponding platform member adjacent the base of each projecting member, the construction and location of each of said projecting members and corresponding platform members being such that each projecting member is adapted to be abuttingly engaged by a corresponding platform member of another pallet and to provide a lateral anti-shift interengagement between adjacent pallets when the pallets are used as tops and bottoms for shipping containers in stacked condition, said projecting members and said platform members also being so constructed and arranged relative to each other that the pallet when in use in a predetermined position of orientation, and at least another position of orientation 180 degrees out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers using this pallet construction and so that clearance is available for the arms of a forklift, each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet, and wherein said protuberances closest to said sleeve receiving groove are spaced from the groove a distance of substantially half that of the distance that the protuberances are spaced apart from each other.

7. A shipping pallet according to claim 6 wherein shoulder means is provided adjacent the lower portion of each of said protuberances for restingly receiving thereon the item to be shipped, said shoulder means having an upper surface on a level above that of said base for maintaining the items positioned on the protuberances in spaced relation from said base.

8. A shipping container according to claim 6 wherein shoulder means is provided adjacent the lower portion of each of said protuberances for restingly receiving thereon the item to be shipped, said shoulder means having an upper surface on substantially the same level as that of said base, and said reinforcing gridwork having portions thereof arranged to provide support to items resting on said shoulder means at a plurality of spaced apart locations on radii extending radially outwardly in various directions from substantially the center of each protuberance.

9. A shipping pallet according to claim 6 wherein said protuberances are frusto conically shaped for guidingly receiving the items to be positioned thereon.

10. A shipping pallet according to claim 6, wherein said rim has a substantially planar inner substantially vertical surface, and means interrupting and extending inwardly from said planar inner vertical surface and adapted to frictionally engage a sleeve positioned in said sleeve receiving groove for aiding in maintaining such sleeve in the groove.

11. A shipping container for containing and transporting a load of items such as packages of yarn or other strand material having tubular carrier cores around which the yarn or other strand material is positioned, said shipping container comprising upper and lower pellets of substantially identical construction, said upper and lower pellets being inverted relative to each other so as to be adapted to be stacked in mating relation to the pallets of adjacent containers, means interconnecting the upper and lower pallets of the shipping container for maintaining the integrity of the shipping container, said pellets each being of unitary construction and having a generally planar base having an outer peripheral rim extending generally upwardly relative to said base and wherein a sleeve receiving groove extends alongside of and is surrounded by said rim, a plurality of spaced protuberances extending upwardly from the upper surface of the base for receiving thereon respective items to be shipped and for maintaining such items in a predetermined relationship, the protuberances on said upper pallet being arranged substantially in alignment with respective protuberances on said lower pallet with the protuberances on the upper pallet being received within the upper ends of tubular carrier cores of the load of items and with the protuberances on the lower pallet being received within the lower ends of tubular carrier cores of the load of items, and said protuberances being so constructed and arranged relative to said tubular carrier cores of the items of the load that the items are substantially prevented from shifting laterally in any direction relative to each other to maintain the items of the load in a predetermined relationship within the container, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding platform member adjacent the base of each projecting member, the construction and location of each of said projecting members and corresponding platform members being such that each projecting member is adapted to be abuttingly engaged by a corresponding platform member of another pallet and to provide a lateral anti-shift interengagement between adjacent pellets when the pellets are used as tops and bottoms for shipping containers in stacked condition, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interefere with the stacking of shipping containers and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet.

12. A shipping container according to claim 11 wherein the load of items comprises a plurality of layers and wherein stabilizing means are provided for cooperating with the items of adjacent layers and for preventing lateral shifting of the items relative to each other for thereby aiding in maintaining the items of the load in a predetermined relationship within the container.

13. A shipping container according to claim 11 wherein the load of items comprises a plurality of layers and wherein stabilizing means is provided between adjacent layers of the load of items for stabilizing the layers of items relative to each other, said stabilizing means comprising a planar member extending substantially parallel to said pallets, and a plurality of spaced protuberances carried by and extending outwardly from opposite sides of said planar member and being received within the proximal end portions of the tubular carrier cores of the load of items for stabilizing the items of the load within the container.

14. A shipping container according to claim 11 wherein the load of items comprises a plurality of layers and wherein stabilizing means are provided for stabilizing the layers with respect to each other, said stabilizing means comprising a plurality of spaced substantially parallel elongate members positioned between the upper and lower pallets and extending substantially parallel to and within the tubular carrier cores of the load of items for interconnecting the items of each layer with items in adjacent layers for aiding in maintaining the items of the load in a predetermined stabilized relationship within the container.

15. A shipping container according to claim 11 wherein the load of items comprises a plurality of layers and wherein stabilizing means is provided between adjacent layers of the load of items, said stabilizing means comprising a plurality of adapters, each adapter comprising a body portion having opposing protuberances thereon positioned within proximal ends of the tubular carrier cores of the load of items for stabilizing the same and further aiding in maintaining the items of the load in a predetermined stabilized relationship within the container.

16. A shipping container according to claim 11 wherein said load of items comprises a single layer of items and wherein the protuberances on the upper and lower pallets are positioned within the opposite end portions of the tubular cores of the single layer of items for maintaining the items of the load in a predetermined relationship within the container.

17. A shipping container for containing and transporting a load of items such as packages of yarn or other strand material having tubular carrier cores around which the yarn or other strand material is positioned, said shipping container comprising upper and lower pallets of substantially identical construction, said upper and lower pallets being inverted relative to each other so as to be adapted to be stacked in mating relation to the pallets of adjacent containers, means interconnecting the upper and lower pallets of the shipping container for maintaining the integrity of the shipping container, said pallets each being of unitary construction and having a generally planar base having an outer peripheral rim extending generally upwardly relative to said base and wherein a sleeve receiving groove extends alongside of and is surrounded by said rim, a plurality of spaced protuberances extending upwardly from the upper surface of the base for receiving thereon respective items to be shipped and for maintaining such items in a predetermined relationship, the protuberances on said upper pallet being arranged substantially in alignment with respective protuberances on said lower pallet with the protuberances on the upper pallet being received within the upper ends of tubular carrier cores of the load of items and with the protuberances on the lower pallet being received within the lower ends of tubular carrier cores of the load of items, and said protuberances being so constructed and arranged relative to said tubular carrier cores of the items of the load that the items are substantially prevented from shifting laterally in any direction relative to each other to maintain the items of the load in a predetermined relationship within the container, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding platform member adjacent the base of each projecting member, the construction and location of each of said projecting members and corresponding platform members being such that each projecting member is adapted to be abuttingly engaged by a corresponding platform member of another pallet and to provide a lateral anti-shift interengagement between adjacent pallets when the pallets are used as tops and bottoms for shipping containers in stacked condition, said projecting members and said platform members also being so constructed and arranged relative to each other that the pallet when in use in a predetermined position of orientation, and at least another position of orientation 180 degrees out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet.

18. A shipping pallet of the forkliftable type and of unitary plastic construction and adapted for use with another substantially identical pallet so as to serve as a bottom or top wall of a shipping container for transporting and storing a load, said shipping pallet having a generally planar base having an outer peripheral rim extending generally upwardly relative to said base and wherein a sleeve receiving groove extends alongside of and is surrounded by said rim, a plurality of spaced hollow protuberances extending upwardly from the upper surface of the base for receiving thereon respective items to be shipped and for maintaining such items in predetermined relationship, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding substantially flat platform member adjacent the base of each projecting member, said projecting members and corresponding platform members of each foot means being symmetrically disposed wih respect to the centerlines of the pallet such that said projecting members are in mirror image relation to the platform members of the corresponding foot means positioned on the opposite side of the centerlines so that each projecting member is adapted to be abuttingly engaged by a corresponding platform member of another pallet and to provide a lateral anti-shift interengagement between adjacent pallets when the pallets are used as tops and bottoms for shipping containers in stacked condition, and so that the pallet when in use in a predetermined position of orientation, and at least another position of orientation 180° out-of-phase therefrom, may be stacked in mating relation to a substantially identical inverted pallet and with the projecting members abutting the platform members of the inverted pallet, all of said projecting members being of hollow construction open at the upper end and tapered for nestability thereof when empty pallets are stacked with each other, said projecting members also having a height which is a substantial portion of the overall height of the pallet and being arranged so as to define forklift passages between the projecting members of a substantially uniform overall height for receiving the arms of a forklift, said projecting members having flat bottom bearing surfaces for vertical load distribution and flat tapered side wall bearing surfaces for self aligning stackability, said flat tapered side walls having an overall height at least several times greater than their thickness and substantially the same as the forklift passages, said height and said hollow construction and said symmetrical arrangement of said projecting members being such that such projecting members may be nestably engaged with projecting members of another substantially identical unloaded pallet facing in the same direction and in a predetermined position of orientation and at least another position of orientation 180° out-of-phase therefrom, whereby a relatively large number of unloaded pallets may be nestably stacked so as to occupy considerably less space when being stored or shipped, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers using this pallet construction and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet.

19. A shipping pallet of the forkliftable type and of unitary plastic construction and adapted for use with another substantially identical pallet so as to serve as a bottom or top wall of a shipping container for transporting and storing a load, said shipping pallet having a generally planar base having an outer peripheral rim extending generally upwardly relative to said base and wherein a sleeve receiving groove extends alongside of and is surrounded by said rim, a plurality of parallel rows of spaced hollow protuberances extending upwardly from the upper surface of the base for receiving thereon respective items to be shipped and for maintaining such items in a predetermined relationship, said rows of protuberances being arranged in lenghtwise and widthwise rows, with said rows in each direction being parallel to each other, said protuberances all being of substantially the same size and shape and substantially uniformly spaced apart from each other, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding substantially flat platform member adjacent the base of each projecting member, said projecting members and corresponding platform members of each foot means being symmetrically disposed with respect to the centerlines of the pallet such that said projecting members are in mirror image relation to the platform members of the corresponding foot means positioned on the opposite side of the centerlines so that each projecting member is adapted to be abuttingly engaged by a corresponding platform member of another pallet and to provide a lateral anti-shift interengagement between adjacent pallets when the pallets are used as tops and bottoms for shipping containers in stacked condition and so that the pallet when in use in a predetermined position of orientation, and at least another position of orientation 180 degrees out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, all of said projecting members being of hollow construction open at the upper end and tapered for nestability thereof when empty pallets are stacked with each other, said projecting members also having a height which is a substantial portion of the overall height of the pallet and being arranged so as to define forklift passages between the projecting members of a substantially uniform overall height for receiving the arms of a forklift, said projecting members having flat bottom bearing surfaces for vertical load distribution and flat tapered side wall bearing surfaces for self aligning stackability, said flat tapered side walls having an overall height at least several times greater than their thickness and substantially the same as the forklift passages, said height and said hollow construction and said symmetrical arrangement of said projecting members being such that said projecting members may be nestably engaged with projecting members of another substantially identical unloaded pallet facing in the same direction and in a predetermined position of orientation and at least another position of orientation 180° out-of-phase therefrom, whereby a relatively large number of unloaded pallets may be nestably stacked so as to occupy considerably less space when being stored or shipped, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers using this pallet construction and so that clearance is available for the arms of a forklift, each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned of the pallet, and wherein said protuberances closest to said sleeve receiving groove are spaced from the groove a distance of substantially half that of the distance that the protuberances are spaced apart from each other.

20. A shipping container for containing and transporting a load of items such as packages of yarn or other strand material having tubular carrier cores around which the yarn or other strand material is positioned, said shipping container comprising upper and lower pallets of substantially identical construction, said upper and lower pallets being inverted relative to each other so as to be adapted to be stacked in mating relation to the pallets of adjacent containers, means interconnecting the upper and lower pallets of the shipping container for maintaining the integrity of the shipping container, said pallets each being of unitary construction and having a generally planar base having an outer peripheral rim extending generally upwardly relative to said base and wherein a sleeve receiving groove extends alongside of and is surrounded by said rim, a plurality of spaced hollow protuberances extending upwardly from the upper surface of the base for receiving thereon respective items to be shipped and for maintaining such items in a predetermined relationship, the protuberances on said upper pallet being arranged substantially in alignment with respective protuberances on said lower pallet with the protuberances on the upper pallet being received within the upper ends of tubular carrier cores of the load of items and with the protuberances on the lower pallet being received within the lower ends of tubular carrier cores of the load of items, and said protuberances being so constructed and arranged relative to said tubular carrier cores of the items of the load that the items are substantially prevented from shifting laterally in any direction relative to each other to maintain the items of the load in a predetermined relationship within the container, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding substantially flat platform member adjacent the base of each projecting member, said projecting members and corresponding platform members of each foot means being symmetrically disposed with respect to the centerlines of the pallet such that said projecting members are in mirror image relation to the platform members of the corresponding foot means positioned on the opposite side of the centerlines so that each projecting member is adapted to be abuttingly engaged by a corresponding platform member of another pallet and to provide a lateral anti-shift interengagement between adjacent pallets when the pallets are used as tops and bottoms for shipping containers in stacked condition, and so that the pallet when in use in a predetermined position of orientation, and at least another position of orientation 180° out-of-phase therefrom, may be stacked in mating relation to a substantially identical inverted pallet and with the projecting members abutting the platform members of the inverted pallet, all of said projecting members being of hollow construction open at the upper end and tapered for nestability thereof when empty pallets are stacked with each other, said projecting members also having a height which is a substantial portion of the overall height of the pallet and being arranged so as to define forklift passages between the projecting members of a substantially uniform overall height for receiving the arms of a forklift, said projecting members having flat bottom bearing surfaces for vertical load distribution and flat tapered side wall bearing surfaces for self aligning stackability, said flat tapered side walls having an overall height at least several times greater than their thickness and substantially the same as the forklift passages, said height and said hollow construction and said symmetrical arrangement of said projecting members being such that said projecting members may be nestably engaged with projecting members of another substantially identical unloaded pallet facing in the same direction and in a predetermined position of orientation and at least another position of orientation 180° out-of-phase therefrom, whereby a relatively large number of unloaded pallets may be nestably stacked so as to occupy considerably less space when being stored or shipped, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned of the respective protuberances and thereby effect enhanced load distribution for all the items positioned on the pallet.

21. A shipping container for containing and transporting a load of items such as packages of yarn or other strand material having tubular carrier cores around which the yarn or other strand material is positioned, said shipping container comprising upper and lower pallets of substantially identical construction, said upper and lower pallets being inverted relative to each other so as to be adapted to be stacked in mating relation to the pallets of adjacent containers, means interconnecting the upper and lower pallets of the shipping container for maintaining the integrity of the shipping container, said pallets each being of unitary construction and having a generally planar base having an outer peripheral rim extending generally upwardly relative to said base and wherein a sleeve receiving groove extends alongside of and is surrounded by said rim, a plurality parallel rows of spaced hollow protuberances extending upwardly from the upper surface of the base for receiving thereon respective items to be shipped and for maintaining such items in a predetermined relationship, said rows of protuberances being arranged in lengthwise and widthwise rows, with said rows in each direction being parallel to each other, said protuberances all being of substantially the same size and shape and substantially uniformly spaced apart from each other, the protuberances on said upper pallet being arranged substantially in alignment with respective protuberances on said lower pallet with the protuberances on the upper pallet being received within the upper ends of tubular carrier cores of the load of items and with the protuberances on the lower pallet being received within the lower ends of tubular carrier cores of the load of items, and said protuberances being so constructed and arranged relative to said tubular carrier cores of the items of the load that the items are substantially prevented from shifting laterally in any direction relative to each other to maintaim the items of the load in a predetermined relationship within the container, a plurality of foot means extending from the base and serving for carrying the load on the pallet, said foot means including corner foot means positioned in respective corner areas of the pallet, central foot means positioned centrally of the pallet, and intermediate foot means positioned between adjacent corner foot means, and wherein said foot means are spaced apart from each other and each foot means comprises at least one downwardly projecting member and a corresponding substantially flat platform member adjacent the base of each projecting member, said projecting members and corresponding platform members of each foot means being symmetrically disposed with respect to the centerlines of the pallet such that said projecting members are in mirror image relation to the platform members of the corresponding foot means positioned on the opposite side of the centerlines so that each projecting member is adapted to be abuttingly engaged by a corresponding platform member of another pallet and to provide a lateral anti-shift interengagement between adjacent pallets when the pallets are used as tops and bottoms for shipping containers in stacked condition, said projecting members and said platform members also being so constructed and arranged relative to each other that the pallet when in use in a predetermined position of orientation, and at least another positon of orientation 180 degrees out-of-phase therefrom, may be stacked in mating relation to a substantially identical inverted pallet and with the projecting members abutting the platform members of the inverted pallet and serving to provide a lateral anti-shift interengagement between the adjacent pallets in a plurality of directions, all of said projecting members being of hollow construction open at the upper end and tapered for nestability thereof when empty pallets are stacked with each other, said projecting members also having a height which is a substantial portion of the overall height of the pallet and being arranged so as to define forklift passages between the projecting members of a substantially uniform overall height for receiving the arms of a forklift, said projecting members having flat bottom bearing surfaces for vertical load distribution and flat tapered side wall bearing surfaces for self aligning stackability, said flat tapered side walls having an overall height at least several times greater than their thickness and substantially the same as the forklift passages, said height and said hollow construction and said symmetrical arrangement of said projecting members being such that said projecting members may be nestably engaged with projecting members of another substantially identical unloaded pallet facing in the same direction and in a predetermined position of orientation and at least another position of orientation 180° out-of-phase therefrom, whereby a relatively large number of unloaded pallets may be nestably stacked so as to occupy considerably less space when being stored or shipped, a reinforcing gridwork of a plurality of reinforcing ribs and valleys located between and adjacent the various projecting members and adjacent the corresponding platform members for strengthening the pallet, the height of said reinforcing ribs and the depth of said valleys being only a fraction of the distance that said projecting members extend from said planar base so that said reinforcing gridwork does not interfere with the stacking of shipping containers and so that clearance is available for the arms of a forklift, and each of said upwardly extending protuberances having one of said downwardly extending projecting members proximally located thereto with the proximally located projecting member being positioned closer to the protuberance than the distance from the protuberance to the next adjacent protuberance so that said downwardly extending projecting members effect enhanced support for each of the items to be positioned on the respective protuberances and thereby effect enhanced load distribution for all the items positioned on the pallet.

* * * * *

UNITED STATES PATENT AND TRADEMARK OFFICE

CERTIFICATE OF CORRECTION

PATENT NO. : 4,580,680

DATED : April 8, 1986

INVENTOR(S) : Joseph H. Wind

It is certified that error appears in the above-identified patent and that said Letters Patent are hereby corrected as shown below:

In column 5, at line 10, delete "junction" and insert ---juncture-- in lieu thereof. In column 8, at line 65, delete "substantially" and insert ---substantially--- in lieu thereof. In column 11, at line 32, delete "protuberance" and insert ---protuberances-- in lieu thereof; and at line 57, delete "protuberance" and insert ---protuberances--- in lieu thereof. In column 12, at line 31, delete "form" and insert ---from--- in lieu thereof; at line 63, delete "protuberance" and insert ---protuberances--- in lieu thereof; and at line 65, delete "protuberance" and insert ---protuberances--- in lieu thereof. In claim 5, column 14, at line 63, insert ---said--- between "in" and "groove". In claim 11, column 16, at line 30, delete "pellets" and insert ---pallets--- in lieu thereof; at line 31, delete "pellets" and insert ---pallets--- in lieu thereof; and at line 36, delete "pellets" and insert ---pallets--- in lieu thereof. In claim 11, column 17, at line 5, in both instances, delete "pellets" and insert ---pallets--- in lieu thereof. In claim 18, column 19, at line 44, delete "wih" and insert ---with--- in lieu thereof. In claim 19, column 21, at line 60, delete "of" and insert --on-- in lieu thereof. In claim 20, column 23, at line 31, delete "of" and insert ---on--- in lieu thereof.

Signed and Sealed this

*Twelfth* Day of *August 1986*

[SEAL]

*Attest:*

DONALD J. QUIGG

*Attesting Officer*

*Commissioner of Patents and Trademarks*